US006481196B1

(12) United States Patent
Chia et al.

(10) Patent No.: US 6,481,196 B1
(45) Date of Patent: Nov. 19, 2002

(54) LENGTH OF JEWELRY ROPE CHAIN EXHIBITING DISTINCTIVE VISUAL PROPERTIES, AND RELATED METHOD OF MANUFACTURE

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 0 days.

(21) Appl. No.: 09/528,821

(22) Filed: Mar. 20, 2000

Related U.S. Application Data

(63) Continuation-in-part of application No. 09/337,455, filed on Jun. 21, 1999, which is a continuation-in-part of application No. 09/287,972, filed on Apr. 7, 1999, now Pat. No. 6,209,306.

(51) Int. Cl.[7] ..... B21L 5/02
(52) U.S. Cl. ..... 59/80; 59/82; 59/35.1; D11/13
(58) Field of Search ..... 59/80, 82, 35.1; D11/13

(56) References Cited

U.S. PATENT DOCUMENTS

| | | | | |
|---|---|---|---|---|
| 1,055,751 | A | 3/1913 | Hurley | |
| 1,886,784 | A | 11/1932 | Boppenhausen | |
| 4,348,861 | A | 9/1982 | Nakagawa | 59/82 |

(List continued on next page.)

FOREIGN PATENT DOCUMENTS

| | | |
|---|---|---|
| EP | D 470 937 A1 | 12/1992 |
| FR | 2 446 612 | 8/1980 |

OTHER PUBLICATIONS

Bisarello Pietro S.r.l., 36010 Cavazzale, Vicenza, Italy, 2 pages.
Solid Gold Bracelets, p. 7.
Fancy Jewelry Imports, 650 S. Hill St. Suite 228, Los Angeles, CA 90014, p. 45.
Chysos S.r.l., Cover page, Via Vallina Orticella, 16, 31030 Borso del Grappa, Treviso, Italy.
Leslie's Jewelry at New York, vol. 698, p. 65, Item 203–3.
Montgomery Ward #459738400, 17" Rope Chain Necklace.
Montgomery Ward #459738301, 7" and 18" Rope Chain Bracelet and Necklace.
Empress Rope Chain, A.K.S. International, 125 W. 45st Street, New York, NY 10036.
Filk SPA–Catene, Via S. Giuseppe, 10–36065 Mussolente (Vicenza) Italy, 2 pages.
Armburst Chain Co. Catalog, 735 Allens Ave., Providence, RI 02905, 1975, pp. 15, 145, 151, and 188.
L'Oromeccanica, Via Marchesane 115A/36061 Bassano Del Grappa (Vicenza) Italy, 1982, 2 pages.
Istor, p. 22; Nuruosmaniye Vezirhan Cd. No: 64 Cemberlitas–Istambul/Turkey.

(List continued on next page.)

*Primary Examiner*—David Jones
(74) *Attorney, Agent, or Firm*—Ladas & Parry

(57) ABSTRACT

A jewelry rope chain exhibiting distinctive visual properties and apparatus and method for creating distinctive visual properties in an assembled rope chain. The distinctive visual properties may be imparted to a length of rope chain assembled with link elements, having the appearance of intertwining helical rope strands. Only one helical rope strand, or both helical rope strands, or any portion of only one helical rope strand, or any portion of both helical rope strands, is colorized after assembly of the length of rope chain so as to exhibit a color for such helical rope strand, or a portion thereof, different from its color prior to colorization.

129 Claims, 13 Drawing Sheets

U.S. PATENT DOCUMENTS

| | | | | | |
|---|---|---|---|---|---|
| 4,651,517 | A | | 3/1987 | Benhamou et al. | 59/80 |
| 4,679,391 | A | * | 7/1987 | Tizzi | 59/35.1 |
| 4,934,135 | A | | 6/1990 | Rozenwasser | 59/80 |
| D313,372 | S | | 1/1991 | Kulla | D11/92 |
| D313,771 | S | | 1/1991 | Kulla | D11/92 |
| 4,996,835 | A | | 3/1991 | Rozenwasser | 59/80 |
| D326,065 | S | | 5/1992 | Borgogni | D11/13 |
| 5,125,225 | A | | 6/1992 | Strobel | 59/35.1 |
| 5,129,220 | A | | 7/1992 | Strobel | 59/80 |
| D329,828 | S | | 9/1992 | Bedoyan | D11/13 |
| D330,175 | S | | 10/1992 | Kahan | D11/13 |
| D330,343 | S | | 10/1992 | Bedoyan | D11/13 |
| 5,185,995 | A | | 2/1993 | Dal Monte | 59/80 |
| D335,834 | S | | 5/1993 | Grotto | D11/15 |
| D340,422 | S | | 10/1993 | Grando | D11/93 |
| D343,136 | S | | 1/1994 | Grando | D11/12 |
| D343,806 | S | | 2/1994 | Bedoyan | D11/13 |
| 5,285,625 | A | | 2/1994 | Ofrat et al. | 59/80 |
| 5,301,498 | A | | 4/1994 | Chia et al. | 59/80 |
| 5,303,540 | A | | 4/1994 | Rozenwasser | 59/80 |
| 5,309,704 | A | | 5/1994 | Grando | 59/13 |
| 5,339,655 | A | | 8/1994 | Grando | 63/9 |
| 5,353,584 | A | | 10/1994 | Strobel et al. | 59/80 |
| 5,361,575 | A | | 11/1994 | Rozenwasser | 59/80 |
| D353,556 | S | | 12/1994 | Chia et al. | D11/13 |
| 5,408,820 | A | | 4/1995 | Strobel et al. | 59/80 |
| 5,412,935 | A | | 5/1995 | Rozenwasser | 59/80 |
| D359,010 | S | | 6/1995 | Rozenwasser | D11/13 |
| 5,425,228 | A | | 6/1995 | Hillel | 59/80 |
| 5,437,149 | A | | 8/1995 | Strobel | 59/80 |
| D362,203 | S | | 9/1995 | Grando | D11/13 |
| 5,452,572 | A | | 9/1995 | Alvaro et al. | 59/80 |
| 5,471,830 | A | | 12/1995 | Gonzales | 59/80 |
| 5,487,264 | A | | 1/1996 | Strobel | 59/80 |
| D368,048 | S | | 3/1996 | Rozenwasser | D11/13 |
| D370,184 | S | | 5/1996 | Rozenwasser | D11/13 |
| D370,426 | S | | 6/1996 | Rozenwasser | D11/13 |
| 5,526,639 | A | | 6/1996 | Gonzales | 59/35.1 |
| 5,531,065 | A | | 7/1996 | Rozenwasser | 59/80 |
| 5,537,812 | A | | 7/1996 | Rozenwasser | 59/80 |
| 5,542,244 | A | | 8/1996 | Chia et al. | 59/35.1 |
| 5,544,477 | A | | 8/1996 | Rozenwasser | 59/13 |
| 5,581,993 | A | | 12/1996 | Strobel | 59/35.1 |
| 5,626,012 | A | | 5/1997 | Fabbro | 59/35.1 |
| 5,653,100 | A | | 8/1997 | Dal Monte | 59/30 |
| 5,660,036 | A | | 8/1997 | Rozenwasser | 59/80 |
| 5,682,736 | A | | 11/1997 | Chia et al. | 59/35.1 |
| 5,775,088 | A | | 7/1998 | Grosz | 59/23 |
| 5,797,258 | A | | 8/1998 | Strobel et al. | 59/35.1 |
| D398,551 | S | | 9/1998 | Kupelain | D11/18 |
| 5,911,677 | A | | 6/1999 | Kupelian | 59/35.1 |
| D424,964 | S | | 5/2000 | Chia et al. | D11/13 |
| 6,209,306 | B1 | * | 4/2001 | Chia et al. | 59/80 |

OTHER PUBLICATIONS

JQ Magazine, The Journal for Professional Jewelers and Designers, 2 pages.

Steven Kretchmer Design, Rte 23A P.O. Box G, Palenville, NY 12463, 1 page.

Aurora, Via Vecchia Ferriera 70, 36100 Vicenza, Italy.

All Karats International, Edizioni, Primavera–Estate/*Spring–Summer*, Sixth Edition, Two–tone Diamond Cut Rope Chain; 2 pages (1998).

K Mart, Item #76617103508, Sterling Silver Two–tone Solid Diamond Cut Rope Chain; 3 pages.

*JQ Magazine*; "Images from our exciting new collection"; 1 page total.

QVC, Item #J64656, 36" Two–tone Solid Rope Necklace, 14K Gold 7.5 grams; 2 pages.

* cited by examiner

FIG. 24
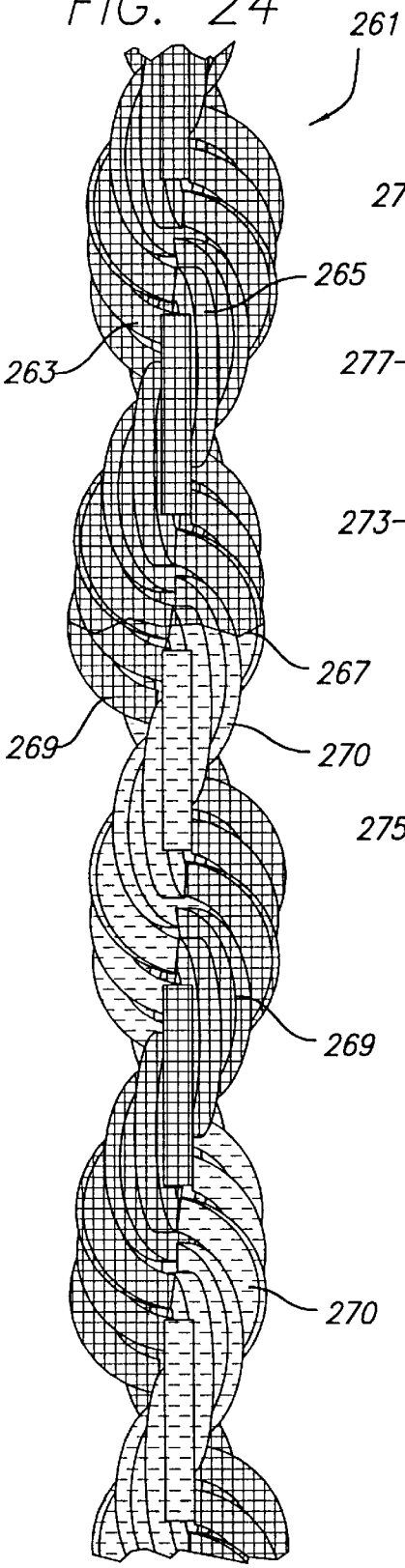
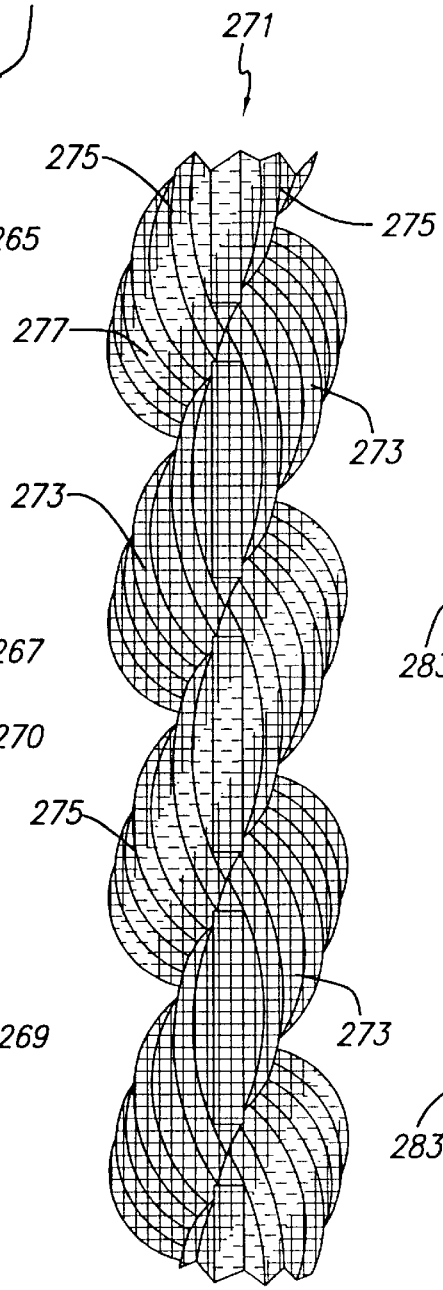
FIG. 25
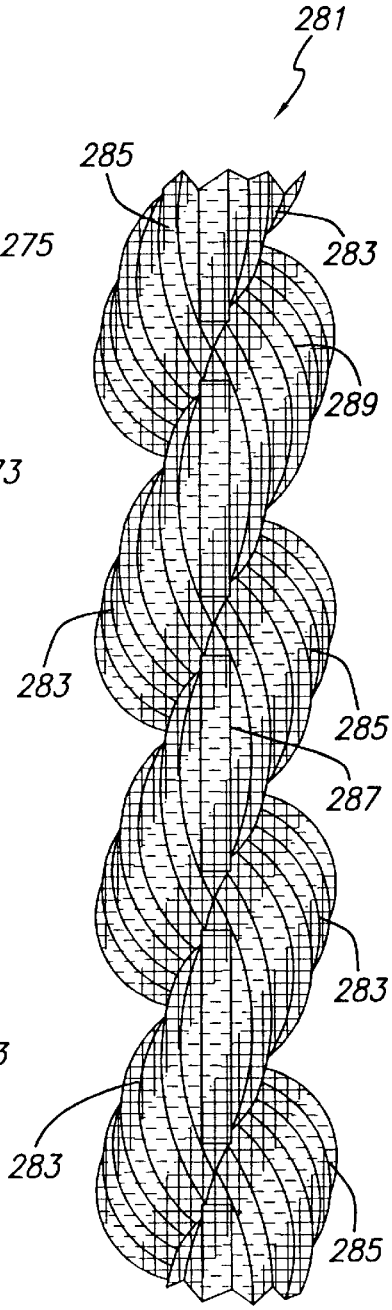
FIG. 26

LENGTH OF JEWELRY ROPE CHAIN EXHIBITING DISTINCTIVE VISUAL PROPERTIES, AND RELATED METHOD OF MANUFACTURE

CROSS-REFERENCE TO RELATED APPLICATIONS AND CERTIFICATES

This application is a continuation-in-part of application Ser. No. 09/337,455, filed Jun. 21, 1999 entitled "JEWELRY ROPE CHAIN LINK ELEMENT", which is a continuation-in-part of application Ser. No. 09/287,972, filed Apr. 7, 1999, now U.S. Pat. No. 6,209,306 entitled "DECORATIVE JEWELRY ROPE CHAIN". Reference is made to U.S. Document Disclosure Certificate Nos. 459911 recorded Jul. 30, 1999, 458876 filed Jul. 5, 1999, 455008 filed Apr. 19, 1999, and 455009 recorded Apr. 19, 1999. The entire contents of all such related applications and certificates are incorporated herein by reference.

BACKGROUND OF THE INVENTION

1. Field of the Invention

This invention relates to the field of decorative jewelry items, and more particularly to an attractive jewelry rope chain exhibiting unusual visual properties.

2. Brief Description of the Prior Art

Jewelry rope chain has been made for many years. Although rope chains can be made by machine, the better quality rope chains are usually manufactured by hand. While a rope chain has the feel and look of a rope, it is actually made up of a series of individual C-shaped flat link elements made from a precious metal such as silver or gold. Gold is available in at least four colors; white, yellow, rose (pink), and green. The C-shaped link elements are fastened together in a particular way, such that tightly interlinking annular link elements give the appearance of intertwining helical rope strands. A number of annular link elements are connected and intertwined together in a systematic and repetitive pattern of orientation, resulting in an eye-pleasing, flexible, and delicate-appearing chain that looks and feels like a finely braided helix.

The assembly method for interconnecting a series of link elements can be found by reference to U.S. Pat. No. 4,651,517 to Benhamou et al. and U.S. Pat. No. 5,301,498 to Chia et al., both of which are incorporated herein by reference.

Some manufacturers of jewelry use different colored gold and silver elements to enhance the beauty of the jewelry article. Examples are: rope chains in which sets of link elements of one color alternate with sets of link elements of another color; and bracelets or necklaces constructed of interconnected twisted closed loops exhibiting alternating colors along their lengths.

However, in all of the prior art construction techniques for producing rope chain jewelry, each link element is of a single solid color, texture, and pattern, e.g., each link element may be stamped from a solid thin sheet of precious metal, such as gold. Thus, for example, while an all yellow gold rope chain or an all white gold rope chain is attractive, it is otherwise uninteresting due to the monotonic nature of its unvarying coloration and/or texture along the link elements of the chain. Those prior art rope chains that do exhibit variations of colors along their lengths nevertheless are constructed of individual link elements each of which is of a single solid color, texture, and/or pattern. Other jewelry articles exhibit variations of colors along their lengths using interconnected twisted closed loops, but they are not regarded as rope chains as defined herein.

SUMMARY OF THE INVENTION

The present invention relates to a jewelry rope chain exhibiting distinctive visual properties and to related means and methods for creating distinctive visual properties in an assembled rope chain. The distinctive visual properties may be imparted to a length of rope chain assembled with link elements all of the same material, shape, configuration, texture, and/or color, or such distinctive visual properties may be imparted to a length of rope chain assembled with link elements differing in material, shape, configuration, texture, and/or color.

For example, in one aspect of the invention, a manufacturing process may be employed to produce a length of jewelry rope chain in which each link element, or a group of link elements, may exhibit a common visual property, i.e., each link element, or group of link elements may have the same surface texture, coloration, attribute, shape, configuration, or other physical appearance prior to assembly, and subsequently be altered to enhance the beauty of the jewelry article by further coloration or texturing process steps.

Thus, in addition to exhibiting unique visual properties, employing the concepts of the present invention, lengths of rope chains can be fabricated in which one of the apparent strands of "rope" has a different visual appearance than the intertwining "rope" strand. That is, the appearance of a rope strand at any point along the length of rope chain may not only be visually different than another point along the length of rope chain, but may also be visually different than the adjacent strand. For example, one strand may have an apparent smaller diameter than that of the adjacent strand. Or, the texture, coloration, surface reflectivity, pattern, shape, or other physical attribute of one strand may be totally distinct relative to the adjacent strand.

In another aspect of the invention, a manufacturing process may be employed to produce a length of jewelry rope chain in which each link element, or a group of link elements, may exhibit a unique visual property, i.e., surface texture, coloration, attribute, shape, configuration, or physical appearance prior to assembly, and subsequently be altered to enhance the beauty of the jewelry article by further coloration or texturing processes.

In either case, such unique visual property traits for the succession of link elements results in a more attractive, fanciful, more delicate and interesting fashion jewelry item.

It will be understood that in all of the examples of the accompanying figures and the related text, where different colors are shown and described, texture or patterns can be implied, and the terms "texture" or "pattern" could be substituted for "color". To avoid unnecessary duplication, however, "color" will be used as exemplary of other visual properties including surface texture and patterns.

Some or all of the link elements making up the length of rope chain may be smoothly circular (e.g., annular), circular with peripheral undulations or crenels, circular with peripheral gear-like teeth, and/or may be star shaped, baguette shaped, square shaped, rectangular shaped, oval shaped, diamond shaped, heart shaped, etc. Similarly, different portions of each link element may have such different physical shapes.

As a result of the various combinations possible in the manufacture of jewelry rope chains in accordance with the present invention, a virtually limitless number of different design possibilities exist, and preferred ones of such possibilities are shown and described herein. It is to be understood, however, that all combinations of: the number of interconnected link elements in the repeated pattern along the length of rope chain; solid or portioned coloration and/or texturing; different designs of the portioned regions of each side surface of the link elements; and different physical shapes and/or visual properties of the individual link elements may be employed in the manufacture of jewelry rope chains and are contemplated as variations of the preferred embodiments specifically shown and described.

BRIEF DESCRIPTION OF THE DRAWING

Further objects and advantages and a better understanding of the present invention may be had by reference to the following detailed description taken in conjunction with the accompanying drawings in which:

FIG. 24 is a front elevational view of a ninth example of a length of rope chain partitioned to show in the upper part of the figure an untreated chain portion, and to show in the lower part of the figure colorization of one of the strands of the rope chain;

FIG. 25 is a front elevational view of another length of rope chain showing a colored helical stripe along the outer periphery of one of the intertwined rope chain strands;

FIG. 26 is a front elevational view of another length of rope chain showing a colored helical stripe along the outer periphery of both of the intertwined rope chain strands;

DETAILED DESCRIPTION OF THE PREFERRED EMBODIMENTS

Figure 1:
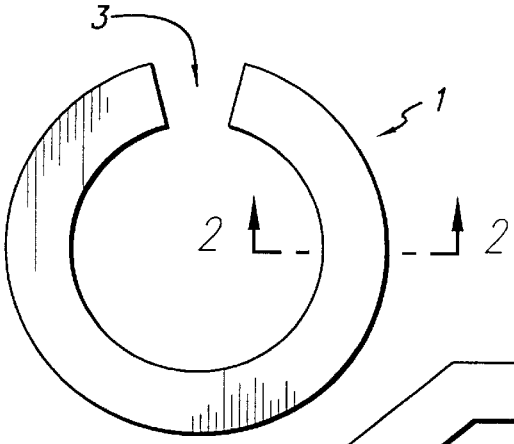
FIG. 1 PRIOR ART
FIG. 1 is a plan view of an annular link element which is the basic building element for the construction of jewelry rope chains as known in the prior art.

FIG. 1 is a plan view of an annular link element used in the construction of jewelry rope chains as known in the prior art.

Figure 1A:
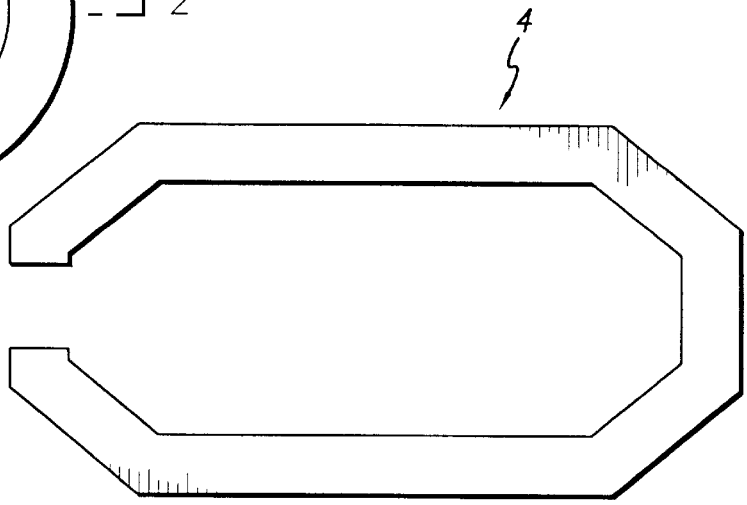
FIG. 1A PRIOR ART
FIG. 1A is a plan view of a baguette shaped link element which may be used with or without other link elements to construct a jewelry rope chain as known in the prior art.

In general, FIGS. 1–4 depict a conventional rope chain arrangement (FIGS. 3 and 4) and a typical annular link element (FIGS. 1, 1A, 2, 2A, and 2B) employed as a basic building element in the construction of a rope chain. The baguette shaped link element 4 in FIG. 1A may be used alone or in combination with standard annular link elements, such as shown in FIG. 1, to construct a rope chain having an appealing appearance.

For the purposes of this description, the following definitions are provided.

"Rope chain" is a series of sets of interlinked, or interconnected, link elements which, after assembly, have the appearance of a plurality of braided, or helically intertwined, multi-fiber strands of hemp, flax, or the like.

A "set" is the number of adjacent interlinked, or interconnected, link elements making up a structurally repeated assembly procedure along the chain. In the accompanying drawing and associated text, a four-link set is used for purposes of ease of visual presentation and description. The number of link elements in a set may be different than the number of link elements making up a repeated visual pattern along the chain.

A "group" is a number of adjacent interlinked, or interconnected, link elements exhibiting identical visual properties. The number of link elements in a group may be the same or different than the number of link elements in a set. Groups may be uniformly or randomly distributed along the rope chain.

A "link element" is the basic building element of a rope chain, a number of which are assembled in a series of interconnected and overlapping link elements to form the rope chain. A link element is typically annular in shape with an open gap having a span slightly greater than the width of the annular link element. However, in accordance with the invention, a link element may have a circular, baguette, oval, diamond, rectangular, square, heart, or other geometrical shape, and each is provided with a gap at a selected position along the length thereof. Accordingly, while the link elements of a rope chain are not necessarily annular, it is the preferred configuration for the basic building element of a rope chain, and for that reason an annular link element will be used in most of the examples shown and described herein.

A "channel" is the path which the eye follows in passing along the rope chain at the apex of a V-shaped helical groove formed between the apparent intertwined rope strands. Hence, in the preferred embodiments described herein, the rope chain has the appearance of a pair of helically intertwined strands of ropes, and thus there exists two such helical channels offset from one another by one-half the pitch of either helix.

A "visual property", as used herein, is a characteristic of an object which presents a particular visual image to the eye. Such characteristics include, but are not limited to, color, texture, pattern, and physical shape. Although shape is generally considered a physical property of an object, in the art of jewelry making, it is often the physical shapes which impart beauty and delicateness to a fashion item.

In the accompanying figures, certain color lining is shown to distinguish the various embodiments depicted. The different colors represent different materials, such as gold and silver, as well as different surface treatments. Since the link elements can be made of virtually any metal, or even non-metals, and since surface treatments can take on an infinite number of color hues and saturations, it would be impossible to illustrate all of the possible color combinations contemplated. Accordingly, the color lining shown in the accompanying figures is intended to be exemplary only, and only color differences are intended to be conveyed when two different color linings are shown on the same link element or on the same length of rope chain. The treatment of text descriptions should be similarly interpreted. For example, when white gold is mentioned, silver, rhodium, nickel, or gold colors other than yellow must be understood to be equivalents.

Figure 2:
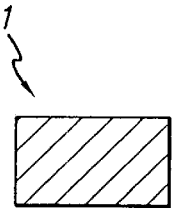
FIG. 2 PRIOR ART
FIG. 2 is a cross sectional view of a solid core annular link element taken along the lines 2—2 in FIG. 1, also known in the prior art.

Referring now to FIGS. 1 and 2, an annular link element 1 is shown to have a generally rectangular cross section (FIG. 2) and a gap 3 having sloping edges, the narrowest width of gap 3 being slightly larger than the thickness of the annular link element 1.

Figure 2A:
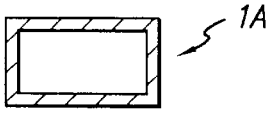
FIG. 2A PRIOR ART
FIG. 2A is a view similar to that of FIG. 2, except that the link element is rectangular and hollow in cross section, as known in the prior art.
Figure 2B:
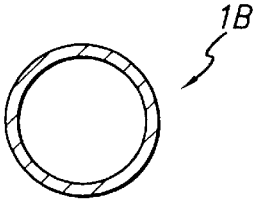
FIG. 2B PRIOR ART
FIG. 2B is a view similar to that of FIG. 2A, except that the link element is circular and hollow in cross section, as known in the prior art.

While conventional rope chains are constructed using annular link elements having a rectangular cross section as shown in FIG. 2, variations with different cross sectional geometries are possible. FIGS. 2A and 2B depict two such variations. The cross section of tubular link element 1A in FIG. 2A is rectangular and hollow (known from U.S. Pat. No. 4,651,517). Another variation is shown in FIG. 2B in which the tubular link element 1B has a hollow circular cross section (known from U.S. Pat. No. 5,129,220). All of the link element embodiments and variations of the present invention illustrated in the accompanying drawing can be solid or hollow in cross section, and may have any geometrical cross sectional shape. A non-limiting solid rectangular cross section is chosen as exemplary in the accompanying drawings for illustrative purposes only.

Figure 3:
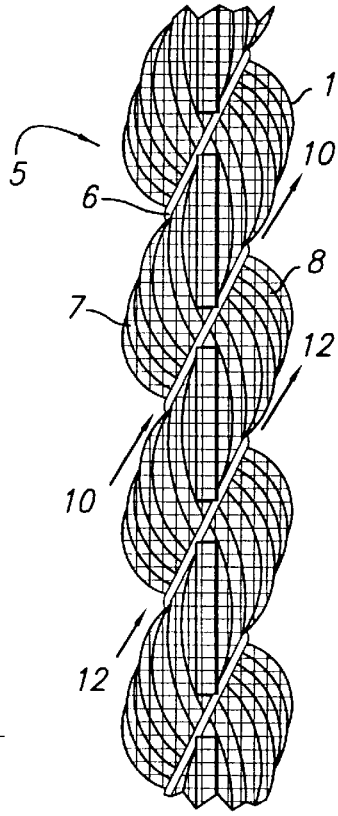
FIG. 3 PRIOR ART
FIG. 3 is a side elevational view showing a section of a prior art rope chain during the manufacturing process, before removing a forming wire used to maintain proper orientation of the series of link elements.
Figure 4:
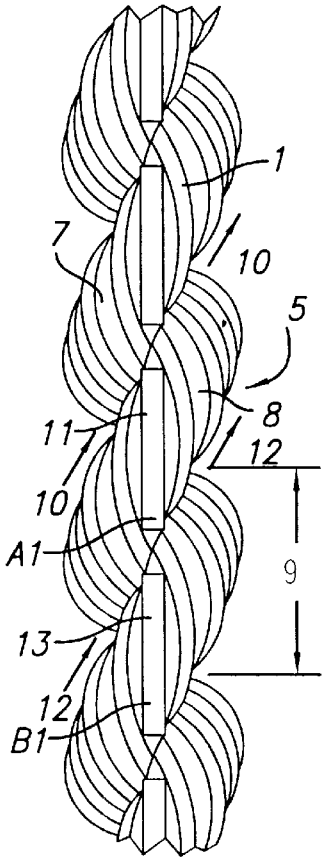
FIG. 4 PRIOR ART
FIG. 4 is a front elevational view of a length of rope chain shaded to show the outward appearance of a length of jewelry rope chain of the prior art exhibiting a uniform visual appearance for all link elements in the chain for the entire length thereof.

Conventional rope chains, such as those shown in FIGS. 3 and 4, are made with a systematic and repetitive interlinking of basic annular link elements 1. Determining the proper dimensions for the annular link element 1 and the gap 3 therein, depending upon the number of desired link elements to form a set of interlinked link elements, can be readily understood by reference to the aforementioned U.S. patents, especially U.S. Pat. No. 4,651,517. As can be viewed in FIGS. 3 and 4 herein, the intertwined link elements 1 of a segment of a conventional rope chain 5 are shown in FIGS. 3 and 4 in the form of a four-link variety. In their assembled form, the series of link elements 1 produce the appearance of a first helical rope strand 7 and a second helical rope strand 8, the combination of which results in a double intertwined helical appearance.

As best seen in FIGS. 3 and 4, the apparent intertwining of a pair of helical rope strands 7 and 8 results in a V-shaped groove between the strands at any position along the length of rope chain. The path along the apex of such V-shaped groove is referred to herein as a "channel", and since there are two apparent rope strands 7 and 8, there are, likewise, two defined channels indicated in FIG. 3 by the directional arrows 10 and 12. Channel 10, along the length of the rope chain, defines a helix, as does channel 12. However, the two channels never intersect one another and are parallel to one another along the length of the rope chain separated axially by one half of the pitch of either of the two channels. In the prior art of FIGS. 3 and 4, there is no visual difference between following along either of the two helical channels 10 and 12, since the rope chain is comprised of a repetitive series of sets of link elements 1, and all link elements have the same visual property (they are all of the same color, texture, and shape, for example).

In FIG. 4, the distance denoted by numeral 9 encompasses the link elements of a repeated visual pattern as viewed from any fixed viewpoint in space. However, typically, it requires two "sets" of link elements to span the distance 9 in FIG. 4. It will be noted that link elements 11 and 13 lie in the same plane, but are angularly displaced from one another along the link elements of the rope chain by 180°. That is, following the position of link element 11 clockwise (as seen from the top) and downwardly, it will be observed that each subsequent link element is angularly spaced at a constant 22.5° angle. Since there are four link elements per set, and typically two sets per 180° turn, in following the link elements downwardly along the rope chain, link element 11 will be effectively rotated 180° to assume the position of link element 13. As is clearly visible in FIG. 4, a series of sets of link elements makes up the length of rope chain illustrated.

In a six-link "set" (not shown), each subsequent link element is angularly spaced at a constant approximately 15° angle.

In the remaining figures of unique link elements to be described, FIGS. 5 and 7–15 illustrate variations of link elements manufactured with a variety of different appealing visual properties.

In this connection, most of FIGS. 5–29 have portions lined or marked to show the colors of yellow gold, white gold or silver, rose (pink) gold, green gold, or rhodium. For a jewelry article such as a rope chain, the typical colors are yellow gold and white gold, but rose and/or green gold areas may also be popular, especially with younger people.

Alternatively, or additionally, portions of a rope chain may be made of a non-gold material, e.g. silver, and any link element surface, or any rope strand surface of the non-gold material can be colorized after the rope chain is assembled. For example, such non-gold material can be subjected to a process for applying a coating of rhodium or other substance to enhance its visual appearance, or it can be coated with a colored enamel, or treated with a blackener or an oxidizer or other surface treatment, the blackener and oxidizer treatments giving the treated material a dark color, e.g., gray to black.

In all of the FIGS. 5–29, the portions of the annular link elements, and therefore the length of rope chain, lined for gold colors may be the result of providing a gold wire and bending segments thereof to form link elements, or the result of stamping the links out of a single or multicolored gold strip, or the-result of gold plating a metallic, or even non-metallic, link element. Alternatively, the link elements may, for example, be laminated with a solid yellow gold layer and a solid white gold layer (see the aforementioned U.S. patent application Ser. No. 09/337,455). It is also within the scope of the present invention to use gapped link elements that have been enameled, rhodium coated, blackened, oxidized, or otherwise surface treated.

Figure 5:
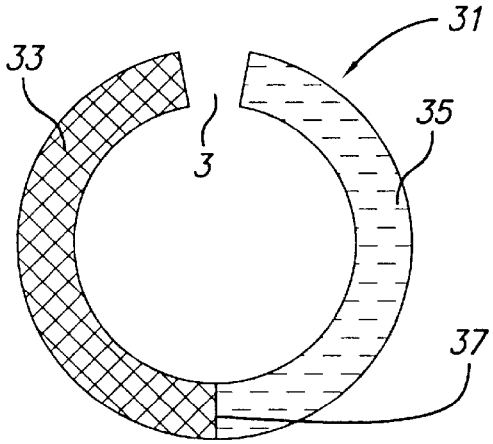
FIG. 5 is a plan view of a first example of an annular link element showing a pattern of two regions on the surface of the link element exhibiting two different visual properties.

FIG. 5 is a plan view of a first example of an annular link element showing a pattern of regions on a surface of a link element 31, exhibiting different visual properties. In FIG. 5, annular link element 31 is divided along a line 37 such that one half 33 of the annular link element 31 between the dividing line 37 and the gap 3 is yellow gold colored, while the other half 35 is white gold colored.

Again (as with all variations shown in FIGS. 5 and 7–12), these colored surfaces 33, 35 may be differently plated, or each link element portion may be made from a solid precious metal such as yellow gold and white gold. In the latter case, the gapped link elements may be stamped from a multicolored flat sheet, striped with a number of alternately colored gold materials, or alternately striped with different materials such as gold and silver. Such a striped flat sheet may be stamped to form gapped link elements in different orientations relative to the stripe pattern and relative to the gap position, resulting in a variety of interesting colored patterns in the finished length of rope chain, yet all such link elements can be stamped from the same striped sheet.

Figure 6:
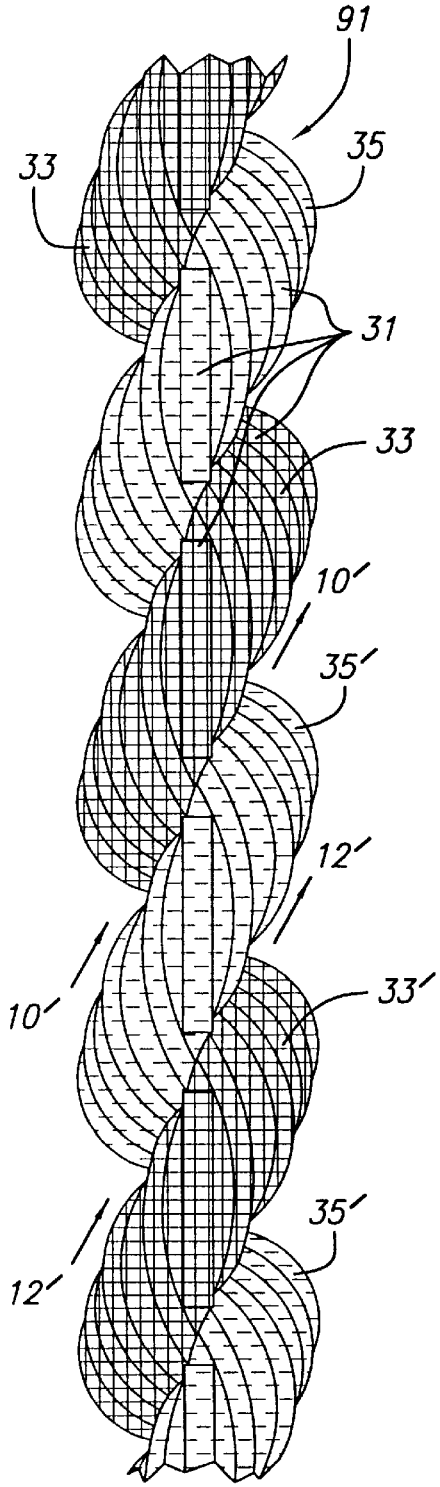
FIG. 6 is a schematic representation of a length of rope chain employing annular link elements of the type shown in FIG. 5, the figure visually suggesting a pair of intertwined helical rope strands lined to show the color yellow gold alternating with the color white gold.

FIG. 6 depicts an embodiment of a length of rope chain 91 showing alternate helical strands 33,55 lined to show the color yellow gold alternating with the color white gold, or a gold material (e.g., 33 in FIG. 5) alternating with a silver material (35 in FIG. 5). The yellow gold and white gold, or silver, pattern shown in FIG. 6 for the length of rope chain 91 is the result of assembling a series of annular link elements 31 in a particular way. Since physical assembly requires every other link element to be inverted relative to its adjacent link element (see U.S. Pat. No. 4,651,517), in order to achieve the two distinctly colored rope strands shown in FIG. 6, during assembly every other link element is additionally reversed in orientation about the axis of the rope chain. It will be appreciated from the drawing of FIG. 6 that the link elements 31 that are perpendicular to the page and shown as a yellow gold color will have a white gold or silver color as viewed from the rear thereof. Similarly, the white gold or silver colored link elements 31 shown perpendicular to the page in FIG. 6 are yellow gold colored in the rear view thereof. Likewise, any link element 31 having a yellow gold colored exposed surface to the right of the axis of rope chain 91 in FIG. 6 will have a white gold or silver color on its exposed surface on the left side of the axis, and vice versa. Accordingly, following along channel 10 for the entire length of the rope chain 91, the right side of the channel 10 will be white gold or silver colored, and the left side will be yellow gold colored. Similarly, following along channel 12, the left side will be white gold or silver, and the right side will be yellow gold.

Thus, in the embodiment of FIG. 6, although all annular link elements 31 are identical, nevertheless, the visual appearance of the finished rope chain is such that an apparent yellow gold colored rope strand is intertwined with an apparent white gold or silver colored rope strand, lending an interesting and attractive alternately colored appearance along the rope chain 91.

Figure 7:
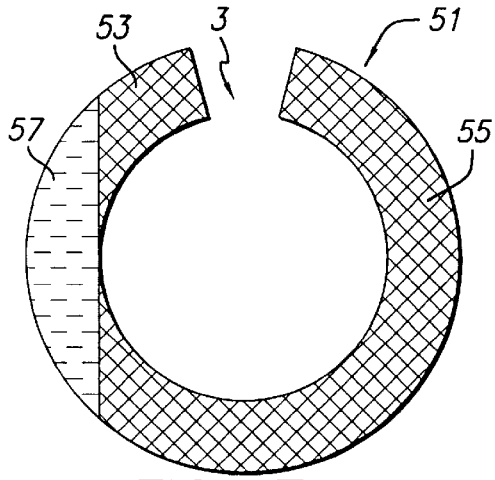
FIG. 7 is a plan view of a second example of an annular link element showing a pattern of three regions on the surface of the link element exhibiting two different visual properties.

FIG. 7 is a plan view of a second example of an annular link element 51 showing a pattern of regions on the surface of the link element exhibiting different visual properties. In FIG. 7, the annular link element 51 has a major curved portion 55 and a minor curved portion 53 of a yellow gold color, while a sector 57 of the annular link element 51 is lined for white gold or silver. A rope chain constructed of a series of link elements 51 may have the appearance of an all yellow gold chain with a white gold or silver colored helical path running along the outer periphery of one of the rope strands.

Figure 8:
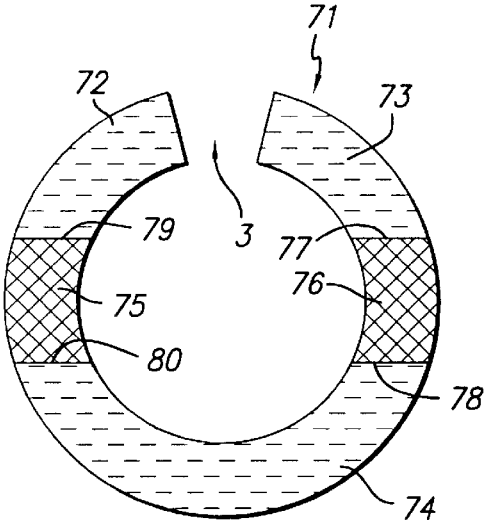
FIG. 8 is a plan view of a third example of an annular link element showing a pattern of five regions on the surface of the link element exhibiting two different visual properties.

FIG. 8 is a plan view of a third example of an annular link element 71 showing a pattern of regions on the surface of the link element exhibiting different visual properties. FIG. 8 shows another possibility in which annular link element 71 has a yellow gold band 75, 76 extending a short distance along a diameter of the link element defining separating lines 77–80, above which, a pair of curved portions 72, 73 are of white gold or silver, and below which an arcuate portion of the link element 71 is also of white gold or silver. A rope chain constructed of a series of link elements 71 may have the appearance of an all white gold or silver chain with small yellow gold helical paths running along the outer periphery of each rope strand.

Figure 10:
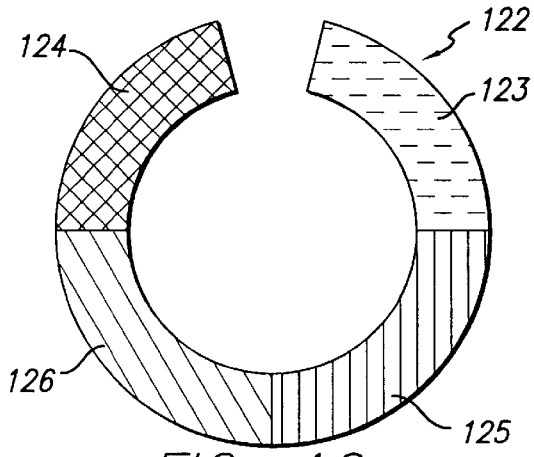
FIG. 10 is a plan view of a fifth example of an annular link element showing a pattern of four regions on the surface of the link element exhibiting four different visual color properties.

Further variations of color patterns on the link elements are presented in FIGS. 9–12. FIGS. 9–12 illustrate the possibility of manufacturing the annular link elements with either or both planar surfaces having different gold colored areas, shown for example on the link element 120 of FIG. 9 symbolically, as yellow (y), white (w), rose (r), and green (g) areas. The link element 122 of FIG. 10 is lined for the gold colors white, yellow, rose, and green for the respective regions 123–126.

Figure 11:
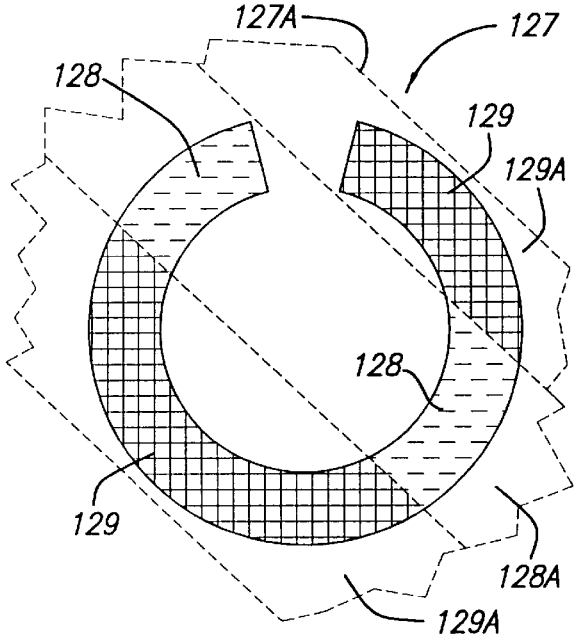
FIG. 11 is a plan view of an sixth example of an annular link element, as it would be stamped from a multicolored sheet of material, showing a pattern of four regions on the surface of the link element exhibiting two different visual color properties.
Figure 9:
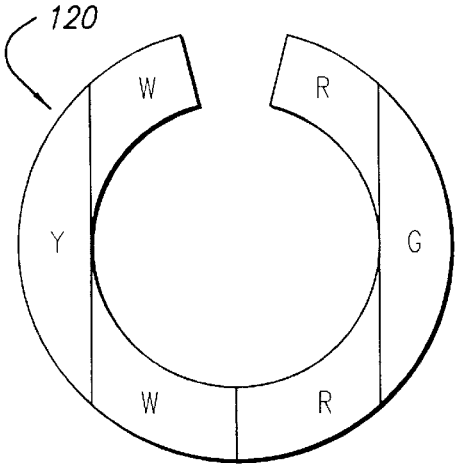
FIG. 9 is a plan view of a fourth example of an annular link element showing a pattern of six regions on the surface of the link element exhibiting four different visual color properties.

FIG. 11 shows a multicolored link element 127 stamped from a multicolored sheet 127A, link element 127 exhibiting the color yellow gold in segments 129 and in strips 129A, and the color white gold or silver in segments 128 and in strip 128A. A rope chain constructed using the link element 127 may produce a primarily yellow gold colored rope chain having the outer periphery of one rope strand exhibiting a white gold or silver helix and one side of one channel of the rope chain also exhibiting white gold or silver.

Figure 12:
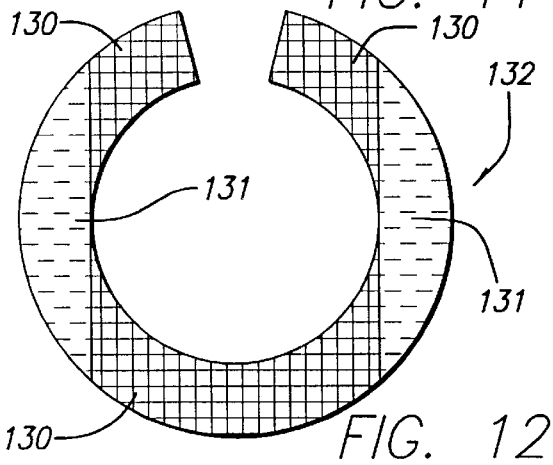
FIG. 12 is a plan view of a seventh example of an annular link element showing a pattern of five regions on the surface of the link element exhibiting two different visual properties.

FIG. 12 shows an annular link element 132 having areas 130 and 131 with variations in color, in this example yellow gold areas 130 and white gold or silver areas 131. A rope chain constructed using links 132 may exhibit yellow gold channels and white gold or silver helixes in the peripheries of both rope strands.

Figure 13:
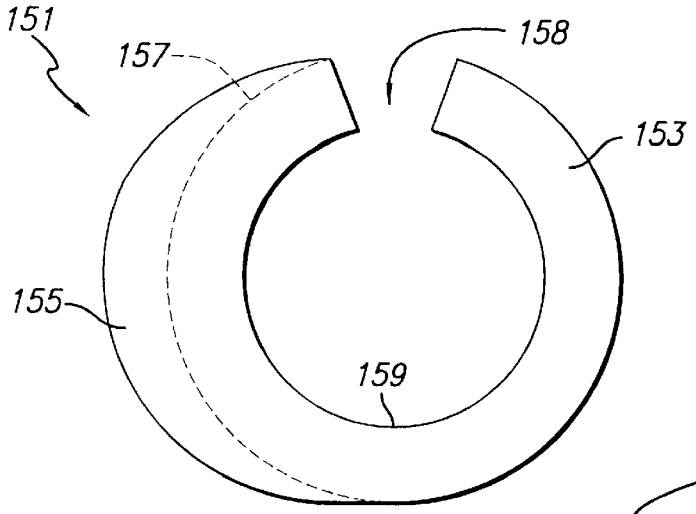
FIG. 13 is a plan view of an eighth example of a link element formed with one side larger than the other side, the transition between the two sides being a smooth transition.

FIG. 13 is a plan view of a link element 151 formed with one side 155 larger than the other side 153, the transition at 159 between the two sides 153,155 being a smooth transition, and the link width at the gap 158 and transition region 159 being of standard width. The dashed line 157 indicates the location of the exterior surface of side 155 if it were not enlarged. When a number link elements 151 are assembled into a length of rope chain, one of the helical rope chain strands will appear to have a larger diameter due to the larger link element width of side 155, and the other helical rope chain strand will appear to have a smaller diameter.

Figure 14:
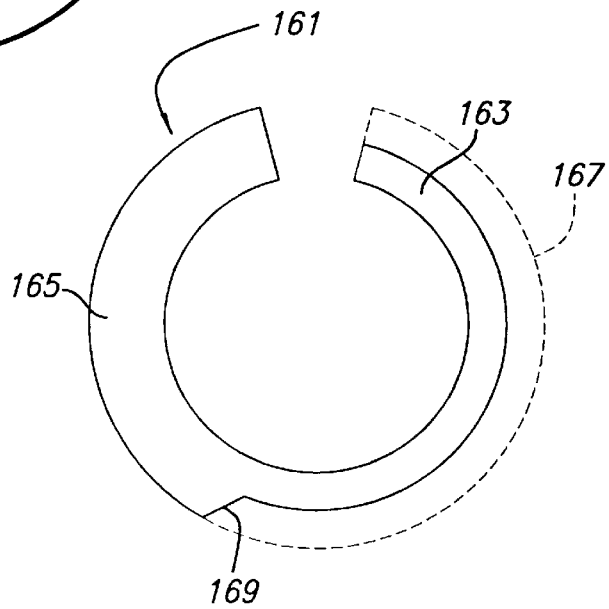
FIG. 14 is a plan view of an ninth example of a link element formed with one side larger than the other side, the relatively abrupt transition between the two sides located on the larger link side.

FIG. 14 is a plan view of a link element 161 formed with one side 165 larger than the other side 163, the relatively abrupt transition 169 between the two sides 163,165 located on the larger link side. The dashed line 167 indicates where the location of the exterior surface of side 163 would be if not reduced in width. The reduction of precious metal in forming the thinner side 163 contributes greatly to lowering the cost of a finished rope chain employing perhaps hundreds of such link elements. When.a number of link elements 161 are assembled into a length of rope chain, one of the helical rope chain strands will appear to have a larger diameter due to the larger link element width of side 165, and the other helical rope chain strand will appear to have a smaller diameter.

Figure 15:
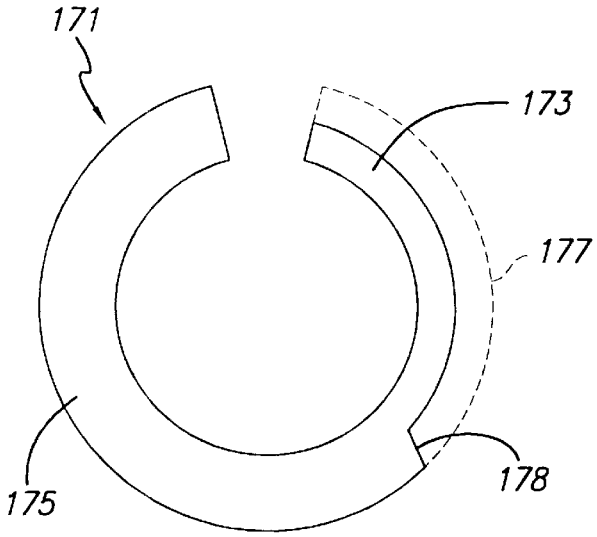
FIG. 15 is a plan view of an tenth example of a link element formed with one side larger than the other side, the relatively abrupt transition between the two sides located on the smaller link side.
Figure 23:
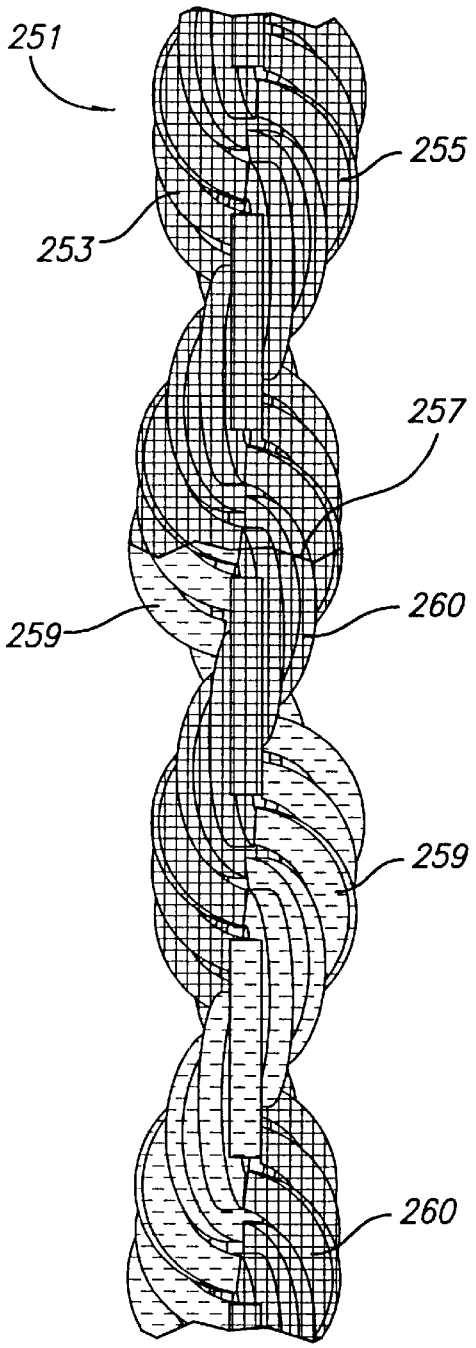
FIG. 23 is a front elevational view of an eighth example of a length of rope chain partitioned to show in the upper part of the figure an untreated chain portion, and to show in the lower part of the figure colorization of one of the strands of the rope chain.

FIG. 15 is a plan view of a link element 171 formed with one side 175 larger than the other side 173, the relatively abrupt transition 178 between the two sides 173,175 located on the smaller link side. The dashed line 177 indicates where the location of the exterior surface of side 173 would be if not reduced. The reduction of precious metal in forming the thinner side 173 contributes greatly to lowering the cost of a finished rope chain employing perhaps hundreds of link elements. When a number link elements 171 are assembled into a length of rope chain, one of the helical rope chain strands will appear to have a larger diameter due to the larger link element width of side 175, and the other helical rope chain strand will appear to have a smaller diameter. FIGS. 23 and 24 are examples which are yet to be described.

Because the transition 178 is on the narrower link side 173 as shown in FIG. 15, the assembled length of rope chain will be tighter than a length of rope chain assembled using the link elements 161 shown in FIG. 14. This more desirable characteristic for rope chains comes at a price, however, i.e., the additional precious metal needed to extend thee wider side 175 up to the transition region 178.

Further varieties of unique colored, textured, or configured link elements other than those shown are possible depending upon the creativity of the jewelry designer following the general concepts presented herein, and reference is made to the aforementioned U.S. patent application Ser. Nos. 09/287,972 and 09/337,455.

Examples of a completed length of rope chain, other than those shown in the accompanying drawing, using combinations of the color patterns and configurations for the link elements shown in FIGS. 5 and 7–15 are left to the artisan having the knowledge of the examples given in this specification to follow for guidance.

After the assembly of a rope chain is completed, portions of the chain may be selectively colorized or textured by post assembly processing. For example, portions of a rope chain may be selectively rhodium coated, or plated, to enhance the brilliance and luster of the coated part. In FIG. 6, for example, after construction, the non-gold rope strand 35' (e.g., silver or other non-gold metal) comprised of the non-gold halves 35 of each link element 31 (FIG. 5) may be coated with rhodium which brightens the non-gold helix 35' and dramatically increases the contrast between the rhodium coated helix 35' and the yellow gold helix 33'. To the eye, such increased contrast effect makes the yellow gold helix 33' appear to be even more yellow in color. This synergistic enhanced visual effect is in addition to beneficially rendering the cost of the completed rope chain much lower.

It is to be understood that, in this description, any suggestion to colorize one or both rope strands of an assembled length of rope chain includes: colorizing the entire outer surface of a rope strand; or colorizing a portion of the rope strand, such as, but not limited to, just the outer periphery of the rope strand, or just the common channel region between rope strands.

Rhodium, gold, or other precious metal plating may be applied to only one helical rope strand, or to selected portions, of an assembled rope chain by a variety of methods and equipment, and reference is made to Pro-Craft® Pen Platers, No. 45.400 and No. 45.403 available from Gorbet USA® Tools, Supplies and Equipment for Technicians and Craftsmen, through NK Supply, Inc. Jewelry Supplies 608 S. Hill St. Suite 602, Los Angeles, Calif. 90014. These pen platers can use formulated pen plating solutions, also available from Gorbet USA®, such as Gorbet USA® No. 45.414 Pro-Craft® plating solution, for plating rhodium. Other pen plating solutions are available for plating metals other than rhodium plating solutions. For example Gorbet USA® Nos. 45.410 through 45.412 are Pro-Craft® gold plating solutions, and No. 45.415 is a Pro-Craft® black rhodium plating solution.

Another method for plating rhodium, gold, or other precious metal on only one helical rope strand, or to selected portions, of an assembled rope chain plating involves three major steps: protective coating all areas of an assembled rope chain that are not to be plated; immersing the partially protected chain in a plating bath (e.g., an electroplating bath); and removing the protective coating. This results in a chain having some non-plated areas (that were protected) and some plated areas added by the plating process. This method is a widely known and therefore does not warrant listing sources for plating materials or plating equipment.

In lieu of rhodium or gold plating, the exterior surface, or portions of the exterior surface, of one or both rope strands of an assembled length of rope chain can be colorized by a blackener process, by an oxidizer process, or by applying and curing a hard colored enamel. The aforementioned Gorbet USA® source supplies Jax® Blackeners such as No. 45.906, Vigor® Oxidizers such as No. 45.0329, and Ceramit™ low temperature curing, hard enamels such as No. 45.800.

All of the above-mentioned plating, blackening, oxidizing, and enameling process result in either a visually attractive color coordinated length of rope chain, or a rope chain in which the different colors exhibited are in much greater contrast than conventional rope chains without any post assembly surface colorization.

Examples of colorized lengths of rope chain are shown in the accompanying FIGS. 16–33.

Figure 16:
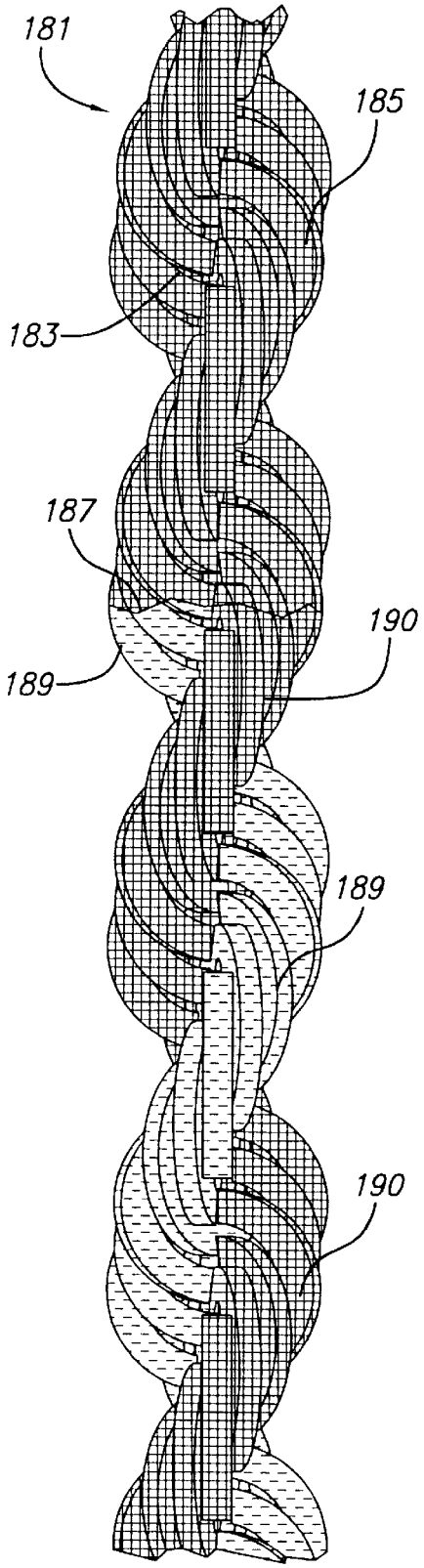
FIG. 16 is a front elevational view of a first example of a length of rope chain partitioned to show in the upper part of the figure an untreated chain portion, and to show in the lower part of the figure colorization of one of the strands of the rope chain.

FIG. 16 is a front elevational view of a length of rope chain 181 showing, in the top portion thereof, before colorization, both rope strands 183,185 being of any color (the color yellow gold being representative) and, in the bottom portion thereof, below the dividing line 187, after colorization, one of the rope strands 189 is the color of rhodium, and the other rope strand 190 is without color change, i.e., it is the same as at 183. The rhodium may be plated onto rope strand 189 as shown in FIG. 16, or onto any rope strand shown in any of the figures yet to be described and which are intended to exhibit the color of rhodium, using a plating process employing one of the aforementioned pen platers.

Figure 17:
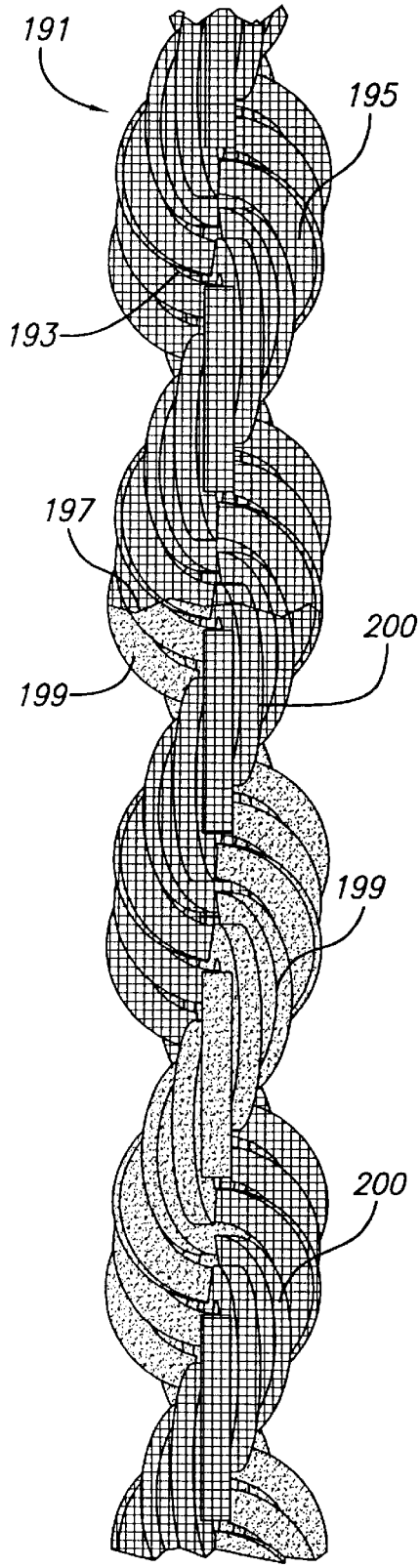
FIG. 17 is a front elevational view of a second example of a length of rope chain partitioned to show in the upper part of the figure an untreated chain portion, and to show in the lower part of the figure colorization of one of the strands of the rope chain.

FIG. 17 is a front elevational view of a length of rope chain 191 showing, in the top portion thereof, before colorization, both rope strands 193,195 being of any color (the color yellow gold being representative), and, in the bottom portion thereof, below the dividing line 197, after colorization, one of the rope strands 199 is of a color different than its original color, and the other rope strand 200 is without color change, i.e., it is the same as at 193. Rope strand 199 may be colorized by any one of the above-mentioned surface treating processes, including rhodium plating, plating with other metals such as gold of a particular gold karat weight or gold of differing gold karat weights, treating the surface with a blackener, with an oxidizer, or by coating the rope strand with enamel. Application of a blackener treatment on silver or gold will produce a dark, black antique finish, while application of an oxidizer on silver or gold will produce all shades from French gray to black. With the application of a low temperature curing, hard enamel, the rope strand surface to be colorized can be changed to virtually any desired color.

Figure 18:
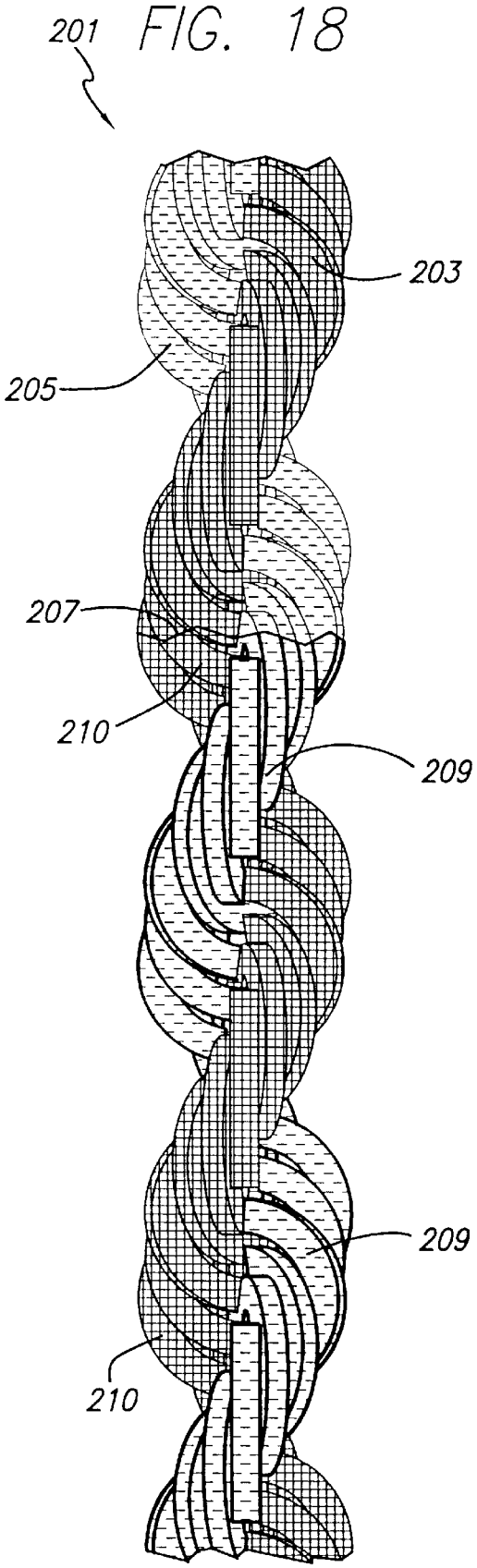
FIG. 18 is a front elevational view of a third example of a length of rope chain partitioned to show in the upper part of the figure an untreated chain portion, and to show in the lower part of the figure colorization of one of the strands of the rope chain.

FIG. 18 is a front elevational view of a length of rope chain 201 showing, in the top portion thereof, before colorization, one rope strand 205 is of any color other than yellow gold and the other rope strand 203 is of the color yellow gold, and, in the bottom portion thereof, below the dividing line 207, after colorization, the non-yellow gold rope strand 209 is the color of rhodium, and the other rope strand 210 is without color change, i.e., it is the same as at 203. In the case where rope strand 205 is made of silver or other metal lower in cost than gold, and rope strand 205 is rhodium plated, a beautiful finished rope chain will result exhibiting an attractive contrast between the untreated yellow gold rope strand 210 and the bright rhodium treated rope strand 209. Yet, the cost of the rope chain is significantly less than a chain assembled with all yellow gold link elements.

Figure 19:
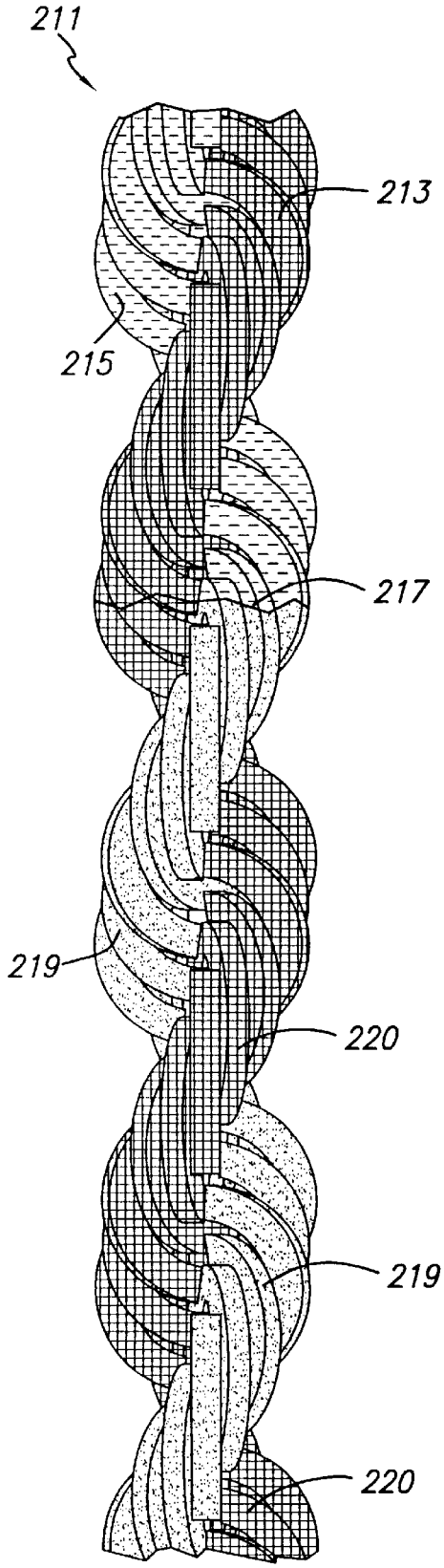
FIG. 19 is a front elevational view of a fourth example of a length of rope chain partitioned to show in the upper part of the figure an untreated chain portion, and to show in the lower part of the figure colorization of one of the strands of the rope chain.

FIG. 19 is a front elevational view of a length of rope chain 211 showing, in the top portion thereof, before colorization, one rope strand 215 is of any color other than yellow gold and the other rope strand 213 is of the color yellow gold, and, in the bottom portion thereof, below the dividing line 217, after colorization, the non-yellow gold rope strand 219 is of a color different than its original color, and the other rope strand 220 is without color change, i.e., it is the same as at 213. As with the length of rope chain shown in FIG. 17, the coloring of rope strand 219 may be achieved by any one of the aforementioned processes including treating the surface with a blackener or oxidizer, or by applying a coat of enamel.

Figure 20:
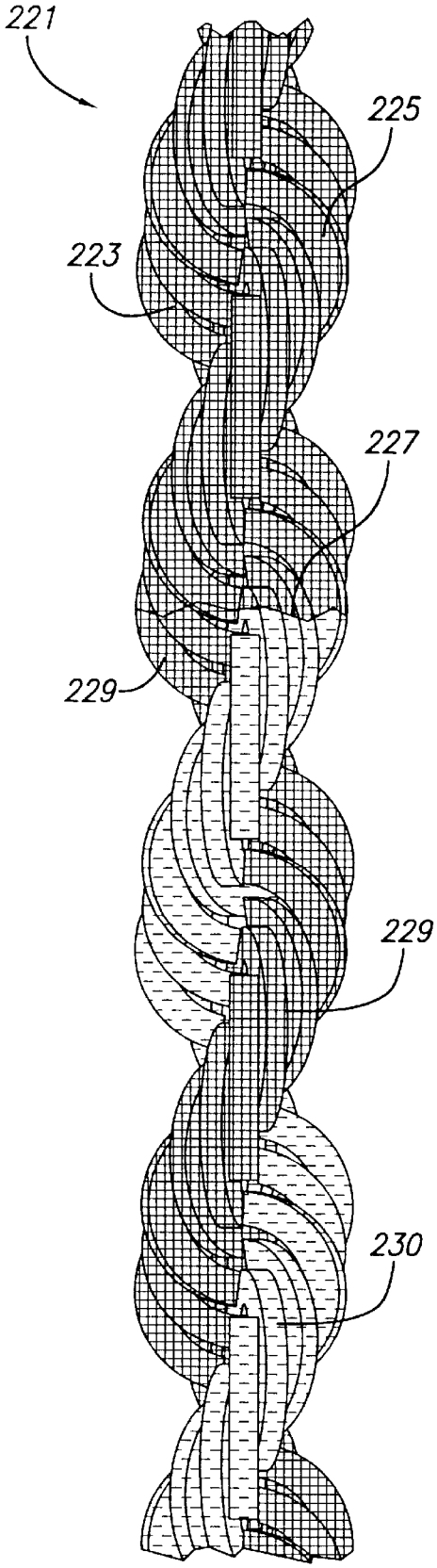
FIG. 20 is a front elevational view of a fifth example of a length of rope chain partitioned to show in the upper part of the figure an untreated chain portion, and to show in the lower part of the figure colorization of one of the strands of the rope chain.

FIG. 20 is a front elevational view of a length of rope chain 221 showing, in the top portion thereof, before colorization, one rope strand 223 is yellow gold of a relatively small gold karat weight and the other rope strand 225 is yellow gold of a relatively larger gold karat weight, and, in the bottom portion thereof, below the dividing line 25 227, after colorization, one rope strand 230 is the color of rhodium, and the other rope strand 229 is without color change, i.e., it is the same as at 225. A finished rope chain employing this method of manufacture can be described as an all gold chain, with one rope strand highlighted by a plate of rhodium. Again, a cost savings is realized by the use of a lower grade of gold under the plated rhodium.

Figure 21:
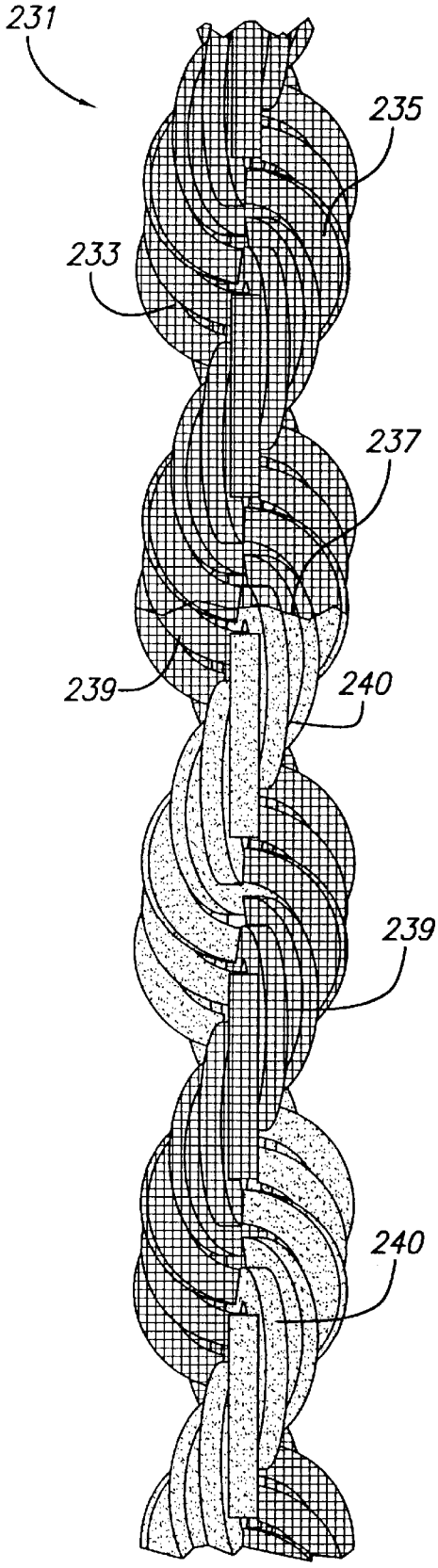
FIG. 21 is a front elevational view of a sixth first example of a length of rope chain partitioned to show in the upper part of the figure an untreated chain portion, and to show in the lower part of the figure colorization of one of the strands of the rope chain.

FIG. 21 is a front elevational view of a length of rope chain 231 showing, in the top portion thereof, before colorization, one rope strand 233 is yellow gold of a relatively small gold karat weight and the other rope strand 235 is yellow gold of a relatively larger gold karat weight, and, in the bottom portion thereof, below the dividing line 237, after colorization, one rope strand 240 is of a color different than its original color, and the other rope strand 239 is without color change, i.e., it is the same as at 235. A finished rope chain employing this method of manufacture can be described as an all gold chain, with one rope strand highlighted by treatment with a blackener or oxidizer, or colored with a coat of hard enamel. Cost savings is realized by the use of a lower grade of gold under the treated or coated rope strand.

Figure 22:
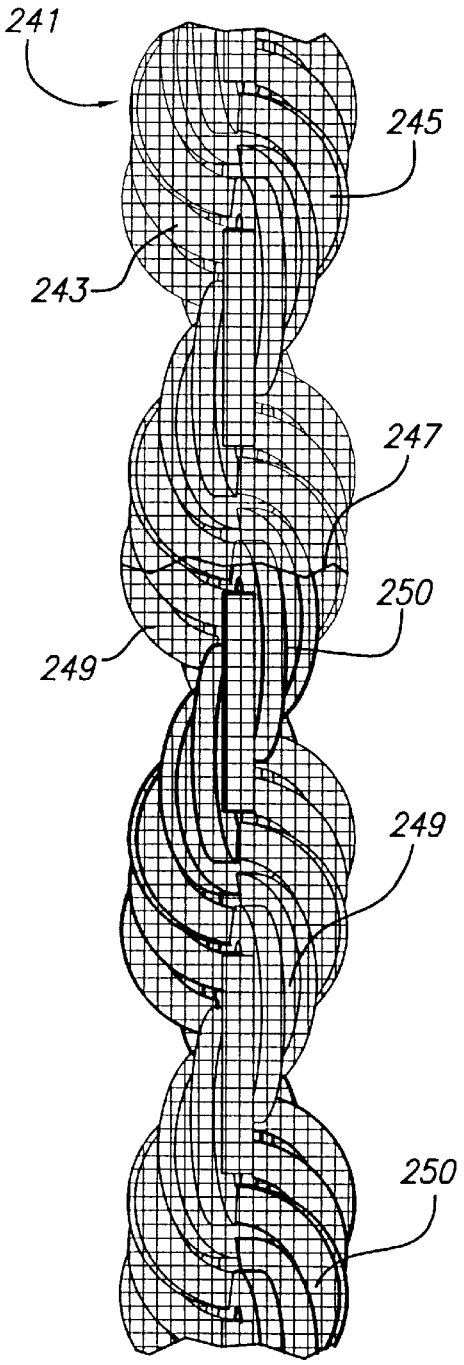
FIG. 22 is a front elevational view of a seventh first example of a length of rope chain partitioned to show in the upper part of the figure an untreated chain portion, and to show in the lower part of the figure colorization of one of the strands of the rope chain.

FIG. 22 is a front elevational view of a length of rope chain 241 showing, in the top portion thereof, before colorization, one rope strand 243 is yellow gold of a relatively small gold karat weight and the other rope strand 245 is yellow gold of a relatively larger gold karat weight, and, in the bottom portion thereof, below the dividing line 247, after colorization, both rope strands 249,250 are of the same gold color and, at least on the surface, of the same gold karat weight. A finished rope chain employing this method of manufacture may be described as an all gold chain, with one rope strand brought to a high karat gold weight by gold, plating the originally lesser gold karat weight rope to match that of the other untreated strand. Cost savings is realized by the use of a lower grade of gold under the gold plated rope strand.

FIG. 23 is a front elevational view of a length of rope chain 251, constructed of link elements of the type shown in FIGS. 13–15, or other similar configurations. Shown in FIG. 23, in the top portion thereof, before colorization, is one rope strand 253 of any color and of a relatively large diameter. The other rope strand 255 is of any color and of a relatively small diameter. In the bottom portion thereof, below the dividing line 257, after colorization, the small diameter rope strand 259 is the color of rhodium, and the other, larger, rope strand 260 is without color change, i.e., it is the same as at 253. This construction conserves precious metal in two ways, first by using less metal in the smaller rope chain strand, and second by plating the small rope chain strand, which may be made from a non-gold material, with rhodium to enhance its appearance. Preferably, rope strand 253 is of yellow gold.

FIG. 24 is a front elevational view of a length of rope chain 261 showing, in the top portion thereof, before colorization, one rope strand 263 is of any color and of a relatively large diameter and the other rope strand 265 is of any color and of a relatively smaller diameter, and, in the bottom portion thereof, below the dividing line 267, after colorization, the large diameter rope strand 270 is the color of rhodium, and the other, smaller, rope strand 269 is without color change, i.e., it is the same as at 265. This construction has similar advantages mentioned in connection with FIG. 23, the only difference being that the larger diameter rope strand is rhodium plated instead of the smaller one. This makes the overall look of the chain more brilliant and to have exceptional luster.

FIGS. 25–33 depict embodiments of the invention wherein not all of a rope strand is treated with a change of color. In these figures, an all yellow gold rope chain is selected as a base for further color processing. It will be understood, however, that any color or any material suitable for the construction of a rope chain can be selected for the manufacture of the link elements making up the chain.

In any event, portions of one or both rope chain strands, are treated after assembly using any one or more of the aforementioned processes of rhodium plating, application of blackeners or oxidizers, coating with enamels, and gold plating.

In the specific examples of FIGS. 25–29, yellow gold rope strands are selected as the basis upon which a stripe of rhodium is plated along a helical path along either or both helical rope strands. Although the figures show a continuous line along either or both helical strands, the stripes of rhodium may be intermittently applied according to any desired pattern. Similarly any combination of striping among the figures can be chosen for unusual effects. Thus, the particular patterns shown in FIGS. 25–29 are not intended to be limiting.

FIG. 25 is a front elevational view of a length of rope chain 271 showing the color of yellow gold for both rope strands 273,275. A helical stripe 277 the color of rhodium is superimposed on one of the rope strands 275.

FIG. 26 is a front elevational view of a length of rope, chain 281 showing the color of yellow gold for both rope strands 283,285. Helical stripes 287 and 289, respectively, the color of rhodium are superimposed on the rope strands 283 and 285.

Figure 27:
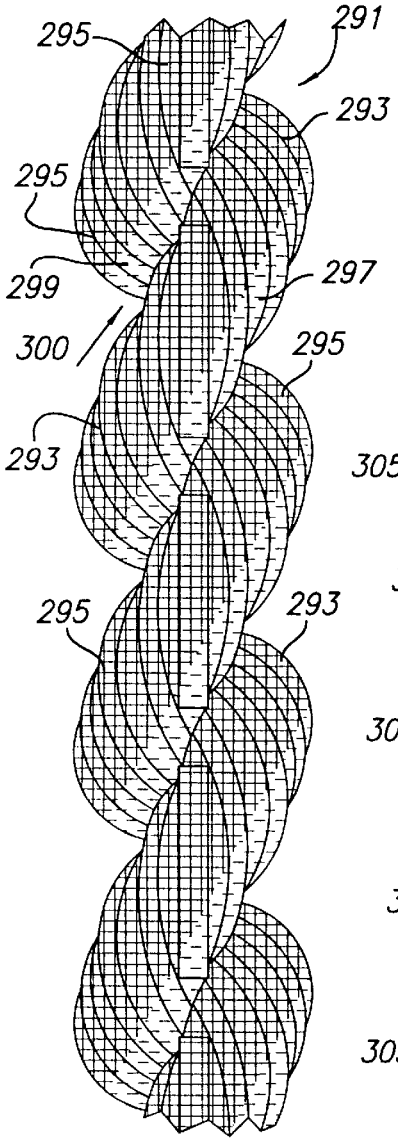
FIG. 27 is a front elevational view of another length of rope chain showing a colored helical stripe along the inner side of one channel of the rope chain.

FIG. 27 is a front elevational view of a length of rope chain 291 showing the color of yellow gold for both rope strands 293,295. A helical stripe 297 the color of rhodium is superimposed on one side 299 of one channel 300 between rope strands.

Figure 28:
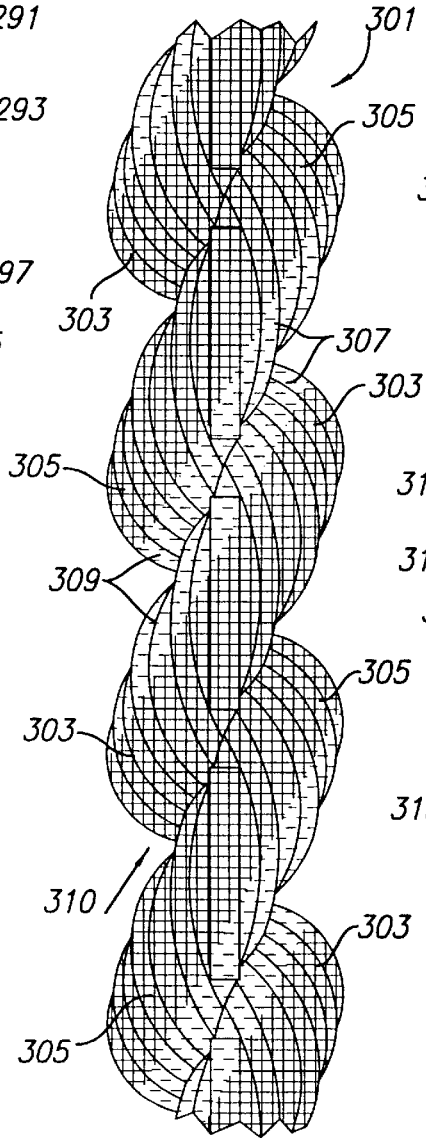
FIG. 28 is a front elevational view of another length of rope chain showing a colored helical stripe along both inner sides of one channel of the rope chain.
Figure 29:
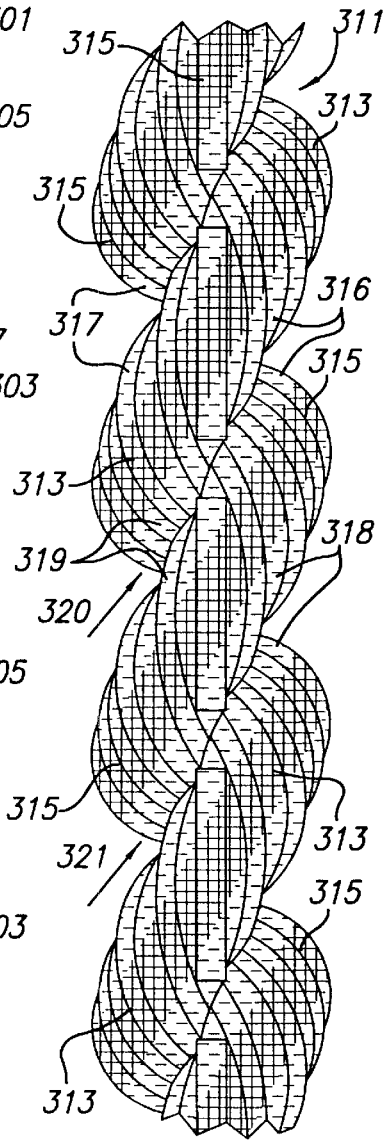
FIG. 29 is a front elevational view of another length of rope chain showing a colored helical stripe along both inner sides of both channels of the rope chain.

FIG. 28 is a front elevational view of a length of rope chain 301 showing the color of yellow gold for both rope strands 303,305. A helical stripe 307 the color of rhodium is superimposed on both sides 309 of one channel 310 between rope strands;

FIG. 29 is a front elevational view of a length of rope chain 311 showing the color of yellow gold for both rope strands 313,315. A helical stripe 316 the color of rhodium is superimposed on both sides 318 of one channel 321 between rope strands, and a helical stripe 317 the color of rhodium is superimposed on both sides 319 of the other channel 320 between rope strands.

Figure 30:
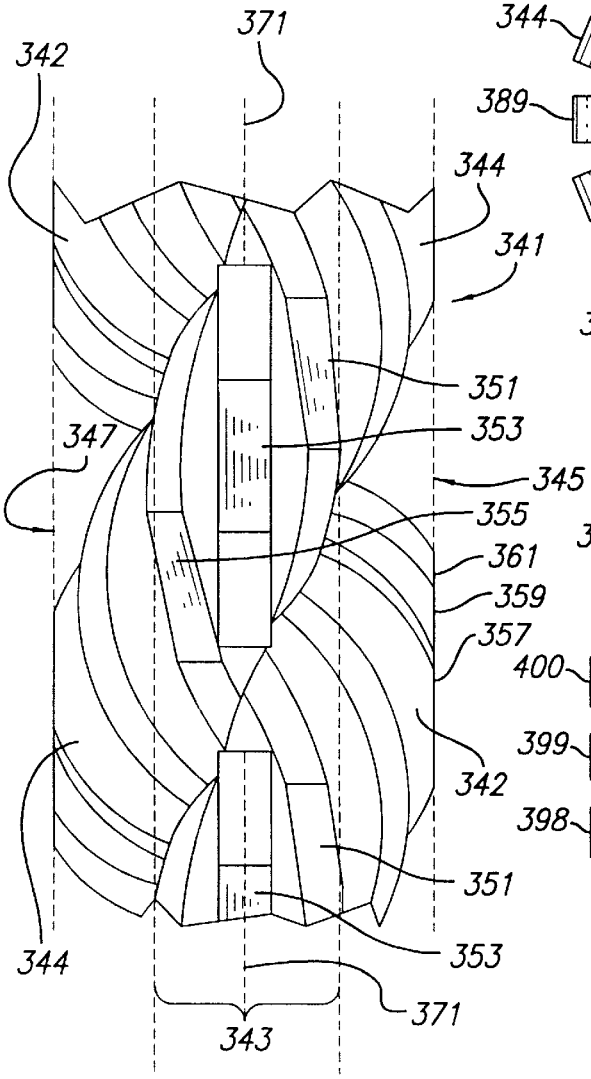
FIG. 30 is a front elevational view of another length of rope chain showing cut portions on four sides.
Figure 31:
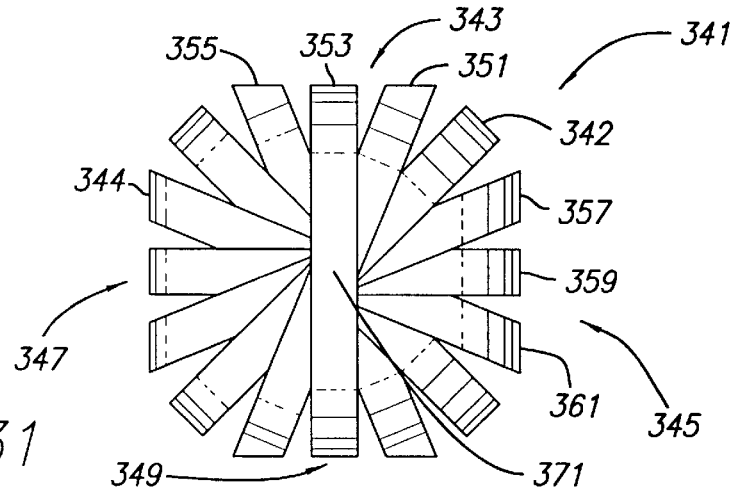
FIG. 31 is an end view of the length of rope chain shown in FIG. 30.

FIGS. 30 and 31 are, respectively, a front elevational view and an end view of another length of rope chain 341 showing cut portions 343, 345, 347, and 349 on four sides, the cut portions defining linear paths along the length of rope chain 341 extending parallel to the rope chain axis 371. In FIGS. 30 and 31, the plane of cut portions 343, 345, 347, and 349 are all equidistant from the axis 371, and widths of the linear paths they follow define flat surfaces on certain link elements 342,344 making up the length of rope chain 341 shown by example with reference numerals 351, 353, 355, 357, 359, and 361. Link elements 342 and 344 are shown to be representative of those link elements that form the separate rope chain strands, one strand being made up of link elements 342 and the other strand made up of link elements 344.

The cut, or faceted, portions 343, 345, 347, and 349 may be formed in any desired way. A preferred way is to diamond cut four linear paths of cut portions 343, 345, 347, and 349 by first laying the length of rope chain 341 out taught between two guides, or by stretching the chain taught around a drum, and then diamond cutting one linear path 343 for example. The chain is then rotated 90° and a second linear path 345 is diamond cut. The process is continued until all four paths are diamond cut.

Figure 36:
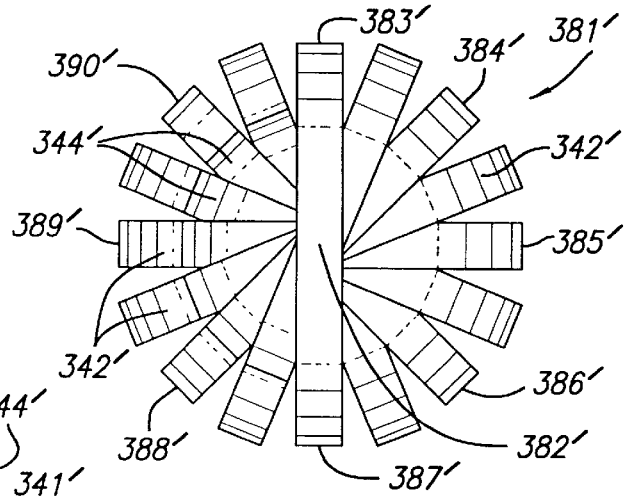
FIG. 36 is an end view of another embodiment of rope chain showing cut portions on eight sides.
Figure 37:
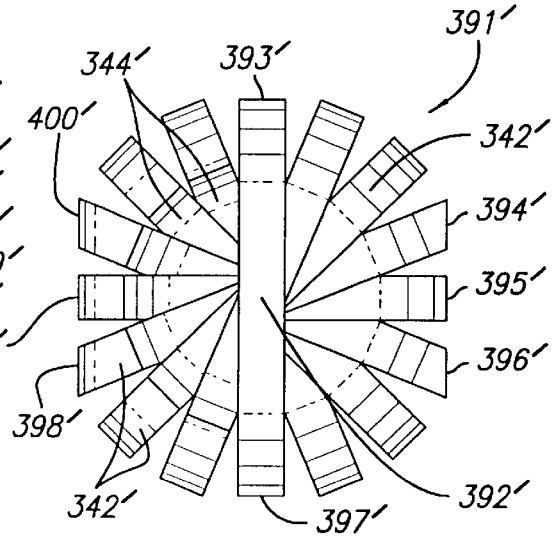
FIG. 37 is an end view of another embodiment of rope chain showing cut portions of unequal spacing from the axis of the chain.

Instead of cutting continuous linear paths of cut portions 343, 345, 347, and 349 along the length of rope chain 341, any or all paths can be cut intermittently along the length of chain. This permits the eye to see more non-plated surfaces, such as yellow gold, and allows deeper cuts without displaying too much shiny rhodium plating which may be overpowering if the cuts on all four sides are deep and plated. Intermittent linear cutting would also be beneficial for the eight facet variation of the invention shown in FIGS. 32 and 36 yet to be described, for the same reasons.

After diamond cutting the four paths of cut portions 343, 345, 347, and 349, the flat edge portions 351, 353, 355, etc. may optionally be colorized to enhance the beauty of the rope chain. Colorization may include plating the flat edge portions 351, 353, 355, etc. with rhodium or gold, or the flat edge portions 351, 353, 355, etc. may be surface treated with a blackener or oxidizer, or the edge portion may be enameled, any of such process being conducted in the manner hereinbefore described.

The length of rope chain 341 so produced may thus be constructed of all yellow gold link elements, and a bright rhodium plating on the diamond cut surfaces presents a highly desirable contrast difference in color along the chain, enhancing its appearance and rendering it more desirable to a prospective purchaser.

Figure 32:
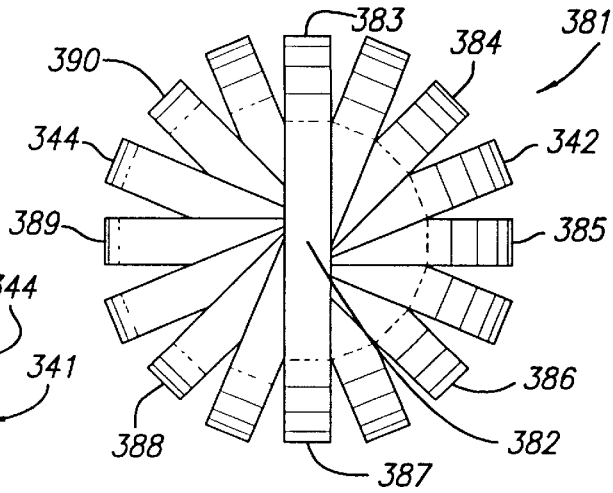
FIG. 32 is an end view of another embodiment of rope chain showing cut portions on eight sides.

FIG. 32 is an end view of another embodiment of rope chain 381 showing cut portions on eight sides 383–390. In FIG. 32, the path width of the diamond cut, for example, is smaller than that of FIGS. 30 and 31, due to the larger number of facets involved. The link elements in between those that show flat cut edges are not affected by the diamond cutting procedure.

A side view of the embodiment according to FIG. 32 is not shown or necessary, since such a view would be self evident to a person skilled in the jewelry art as to precisely how a side view would appear, especially after observing the side view of the four faceted rope chain segment shown in FIG. 30.

The eight faceted rope chain of FIG. 32 is particularly attractive when a yellow gold chain is diamond cut along the eight small width paths and then plated with rhodium. The overall look is a primarily yellow gold chain with thin delicate paths of contrasting bright rhodium accenting the appearance of the chain.

As with the previous embodiment, the diamond cut paths of FIG. 32 are all parallel to the axis 382 and equidistant therefrom. The process for forming the flat surfaces 383–390 may be the same as that described in connection with FIGS. 30 and 31, except the chain will be rotated about its axis 45° seven times after the first cut along the chain. Also, the distance of the diamond cutter tool to the axis 382 will be greater.

Colorizing the cut edges may be performed in the same manner described in connection with FIGS. 30 and 31.

Figure 33:
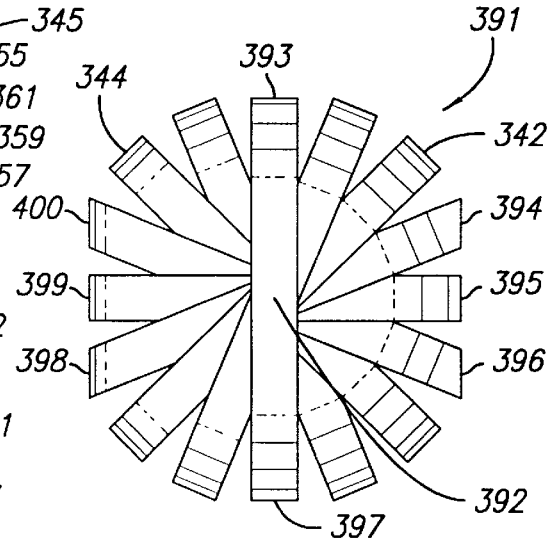
FIG. 33 is an end view of another embodiment of rope chain showing cut portions of unequal spacing from the axis of the chain.

FIG. 33 is an end view of another embodiment of rope chain 391 showing cut portions 393–400 on four sides, the cut portions defining linear paths along the length of rope chain 391 extending parallel to the rope chain axis 371. In FIG. 33, the cut portions 393 and 397, on opposite sides of the chain, are equidistant from the axis 392. Similarly, the planes of cut portions 394–396 and 398–400, on opposite sides of the chain are also equidistant from the axis 371. However, the planes of cut portions 394–396 and 398–400 are closer to the axis 392 than the cut portions 393 and 397. As a result, the widths of adjacent linear paths defined by the diamond cut portions are different, and when rhodium plated, give a unique appearance to the chain in the form of alternate large and small width bright rhodium paths extending along a yellow gold chain, for example.

A side view of the embodiment according to FIG. 33 is not shown or necessary, since such a view would be self evident to a person skilled in the jewelry art as to precisely how a side view would appear, especially after observing the side view of the four faceted rope chain segment shown in FIG. 30.

The cut, or faceted, portions 393–400 may be formed in any desired way. A preferred way is to diamond cut four linear paths of cut portions by first laying the length of rope chain 391 out taught between two guides, or by stretching the chain taught around a drum, and then diamond cutting one linear path 393 for example at a prescribed distance from the axis 392. The chain is then rotated 180° and a second linear path 397 is diamond cut. The chain is then rotated 90°, the cutter is moved closer to the axis 392, and a third linear path (in the plane of cut portions 394–396) is diamond cut. The chain is then rotated 180° and a fourth linear path (in the plane of cut portions 398–400) is diamond cut.

Colorizing the cut edges may be performed in the same manner described in connection with FIGS. 30 and 31.

The length of rope chain 341 so produced may thus be constructed of all yellow gold link elements, and a bright rhodium plating on the diamond cut surfaces presents a highly desirable contrast difference in color along the chain, enhancing its appearance and rendering it more desirable to a prospective purchaser.

In FIGS. 30–33, and in the descriptions of such figures, it is assumed that the link elements 342,344 are all annular links with constant annular widths. Employing non-symmetrical link elements, such as those shown in FIGS. 13–15, rope chains such as those shown in FIG. 23 and 24 can be constructed, with one rope strand of a relatively large diameter and the other rope strand of a relatively small diameter. Applying post assembly diamond cutting and colorization techniques, interesting and attractive patterns on the finished rope chain can be accomplished.

For example, FIGS. 34–37 are near duplicates of FIGS. 30–33, except that the rope chains of FIGS. 34–37 are constructed of link elements like those of FIGS. 13–15 to produce one rope strand of a relatively large diameter and the other rope strand of a relatively small diameter. A full understanding of FIGS. 34–37 can be appreciated by the description to follow and by the fact that prime numbers have been used to designate like details to those of FIGS. 30–33 discussed above.

Using such a wide/narrow link element configuration, the assembled rope chain can be subjected to a diamond cutting procedure, and such diamond cuts will be effective to remove precious metal only on the wider halves of the individual link elements, in FIGS. 34–37, these being link elements 342'. Link elements 344' are of a smaller diameter, and the corresponding smaller diameter rope chain strand is unaffected by the diamond cutting procedure.

As a result, with four and eight faceted linear diamond cuts along the length of the rope chain 341', every other rope strand is faceted, and every in-between strand is not faceted, producing an interesting visual effect. The diamond cutting of one rope strand and not the other can best be seen in the end views of FIGS. 35–37. Of course, if desired, the diamond cuts can be made deeper, or the smaller diameter rope strand can be made larger such that both the relatively larger and smaller strands are diamond cut. If the smaller diameter strand is only slightly diamond cut, i.e. at the outer peripheries of the link elements 344', an attractive combination of wide band cuts and narrow band cuts will result.

Figure 34:
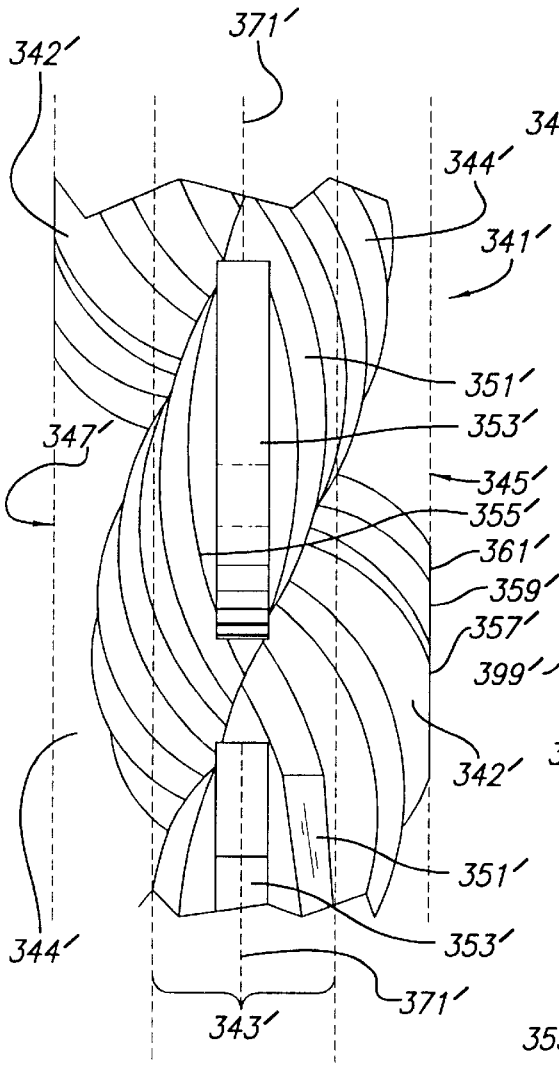
FIG. 34 is a front elevational view of another length of rope chain showing two different diameters of rope strands and cut portions on four sides.
Figure 35:
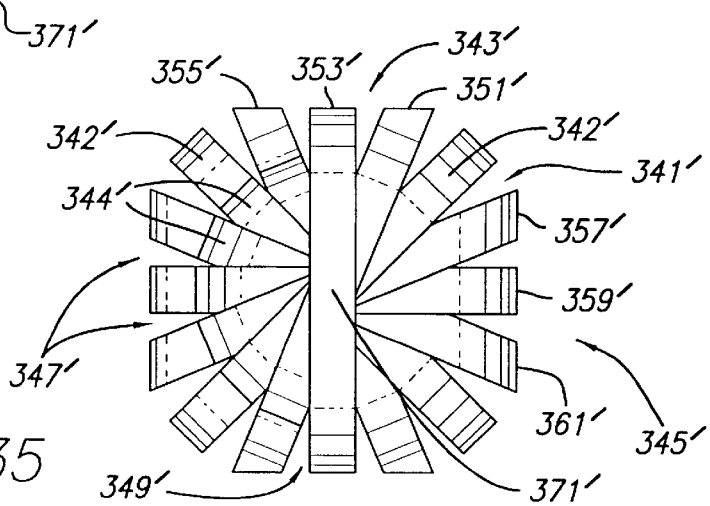
FIG. 35 is an end view of the length of rope chain shown in FIG. 34.

As with the colorization of rope chain strands or portions of rope chain strands heretofore shown and described, the diamond cut portions of the rope chains shown in FIGS. 34–37 can be similarly colorized employing the methods and materials for gold plating, rhodium plating, blackening, oxidizing, and enameling. Additionally, in the rope chain examples of FIGS. 34–37, an extra dimension of colorization is made possible. For example, a rope chain can be produce having a yellow gold large diameter rope strand 342' and a less expensive silver small diameter rope strand 344'. After assembly and diamond cutting as shown in FIGS. 34 and 35, the large diameter gold strand 342 may have its diamond cut edges rhodium plated, and a blackener can be applied to the entire smaller diameter silver rope strand, giving a three-color highly unique rope chain pattern in which the yellow gold portion is prominent, with a rhodium streak intermittently showing on the gold strand, and the smaller strand of a darker color.

Figure 38:
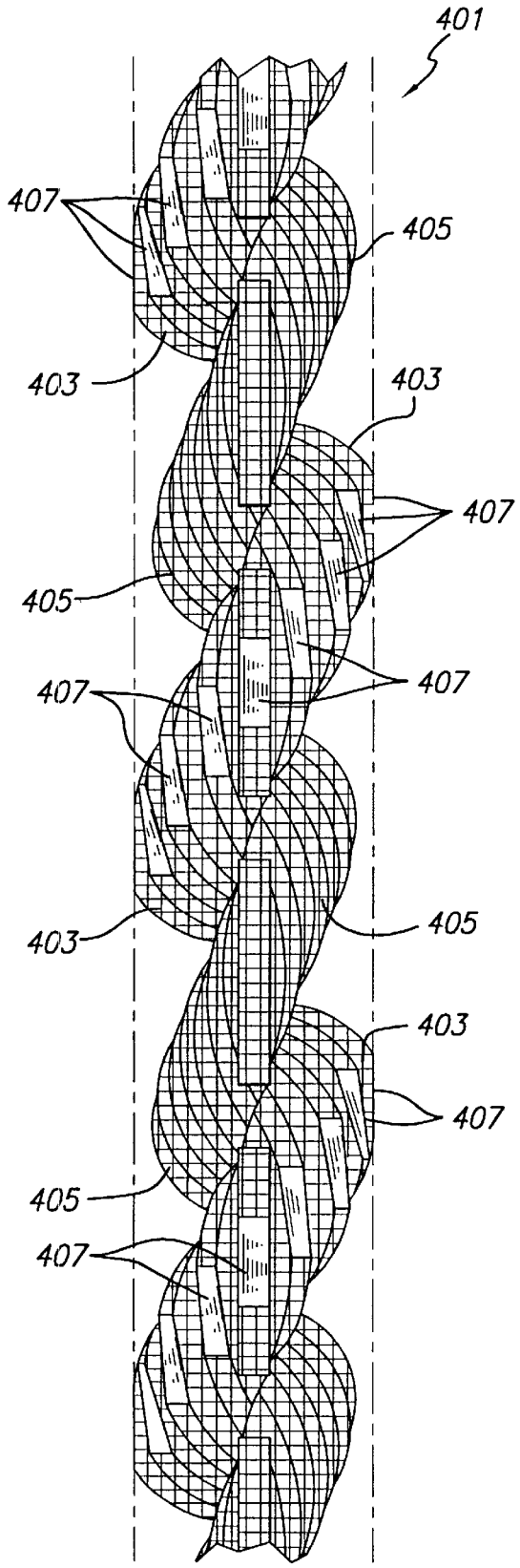
FIG. 38 is a front elevational view of another length of rope chain showing helical cut portions on only the larger of the two rope strands.

FIG. 38 is yet another example of length of rope chain 401 that has unique coloration and patterned features. Like rope chain 341, it is made up link elements to produce a relatively large diameter strand 403 alternating with a relatively small diameter strand 405. Instead of diamond cutting a linear path parallel to the axis of the rope chain, the chain 401 is subjected to selective diamond cutting along the periphery of the larger diameter strand 403. This produces a helical diamond cut path along the outer periphery of strand 403. After colorization of the diamond cut portions 407, a yet further unique rope chain results. This model of rope chain can be further enhanced by employing other techniques and procedures noted above, concerning the change of depth of the diamond cut, the type and color choice of the colorization procedure, and treating the smaller diameter strand 405 differently than that of the larger diameter strand 403.

It is to be understood that the diamond cut paths shown in FIGS. 30–38 can be of any practical width, at the discretion of the jewelry designer.

Additionally, rather than forming a flat, or planar, diamond cut path, any desired configuration of the cutter can be chosen to produce, for example, concave, convex, stepped, rounded, or serrated edge surfaces on the link elements comprising the rope chain.

Although it has been described that the length of rope chain is held taught while forming linear paths parallel to the axis, completed rope chains have much flexibility, and it is inherent in rope chains that some twisting, in use, is natural and expected. Thus, while the diamond cut paths are made in a linear pass along the length of the rope chain during the cutting procedure, in use the paths may take on variable orientations and configurations. This characteristic of rope chains adds to the visual attraction of the jewelry article, since otherwise the chain would exhibit all parallel lines and lose the glitter and surprising light reflecting phenomenon associated with flexible rope chains.

Figure 39:
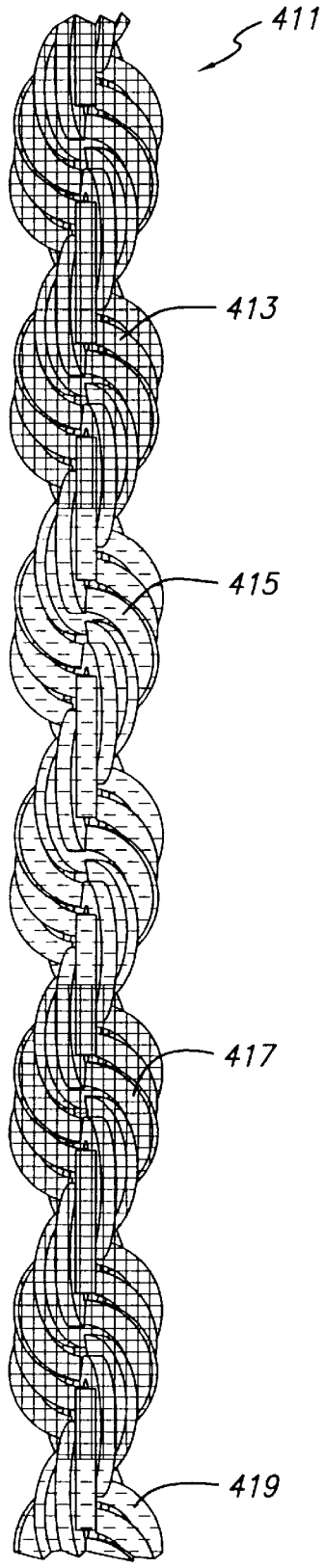
FIG. 39 is a front elevational view of another length of rope chain showing alternating colored chain segments along the length of the rope chain.

FIG. 39 is a front elevational view of a length of rope chain 411 which has portions colored subsequent to assembly of the link elements making up the chain. Employing any of the plating methods described herein, whole segments of chain are plated around the entire body of the chain segment for a prescribed length, alternating with segments that are not plated. For example, in the embodiment shown in FIG. 39, a rope chain 411, initially constructed of solid yellow gold link elements, has a short non-plated segment 413 followed by a short rhodium plated segment 413, then another non-plated segment 417, and then another rhodium plated segment 419, etc., giving the finished rope chain a "zebra" look. For purposes of illustration only, the plated and non-plated segments are all one full helical turn in length. It is to be understood that any length of plated segments alternating with any length of non-plated segments are contemplated, at the discretion of the jewelry designer, while maintaining the "zebra" pattern.

If desired, the jewelry designer may choose to give any of the described embodiments of the finished rope chain a soft lusterless appearance, i.e., instead of rhodium coating to increase reflectivity and brilliance, the finished rope chain may be mechanically or chemically treated so as to have a sandblast, matt, or frost like finish. Such surface texturing can be achieved by selectively acid etching one rope strand or portions thereof, or by electro-etching away surface material in the manner of EDM electro-machining, or by applying a surface ablating or surface furbishing or surface grinding with a small rotary tool or diamond cutting tool.

Another possibility with the present invention is the ability to assemble virtually any color, texture, or shape combination along the length of the rope chain not grouped into patterns correlated with the number of links elements in a set. That is, a color/texture/shape combination, repeated or not, may extend along any number of link elements and not be bounded by the chosen number of link elements per set. One example of this is a length of rope chain having color patterns in groups of thirteen link elements, while a set for this particular length of rope chain may comprise four link elements. Moreover, it is within the scope of the present invention to construct a length of rope chain with sets made up of different numbers of link elements, e.g., 4-link, 6-link, and 8-link sets may be assembled in the construction of the same rope chain.

The embodiments of the invention shown in FIGS. 16–38 provide a basis for appreciating the virtually limitless design patterns that can be produced by arranging the differently colored, patterned, or textured annular link elements such as those shown in FIGS. 5 and 7–15 in a rope chain structure and optionally applying a coating or otherwise treating the surface or a portion of the surface of one or both rope strands of an assembled length of rope chain.

Obviously, color and texture configurations other than those shown in FIGS. 5 and 7–15 are possible for the manufacture of the annular link elements, and these are merely examples of preferred visual property combinations which can produce striking results in a finished rope chain construction. Accordingly, it is to be understood that the patterns shown, the types of materials used, the coloring, implied surface texture and surface patterns, arrangement of groups and sets of link elements along the length of rope chain, reversed or not, randomly assembled or in strict accordance with a repeated pattern, and the like are all contemplated possibilities and are to be considered within the scope of the present invention.

In some embodiments described in this specification and shown in the accompanying drawing, only one helical rope strand is colorized or textured, in whole or in part. The benefits of this processing and construction have been detailed above. It is intended that the same concepts of the invention can be applied to embodiments where both strands are colorized or textured, in whole or in part. For example, a rope chain made with low karat weight yellow gold for both strands maybe subjected to a rhodium plating on one rope strand and a high karat weight plating on the other strand. Similarly, one strand can be high gold karat weight plated and the other strand could be subjected to the application of a blackener or oxidizer, or coated with hard enamel. It is thus to be understood that any process or construction described herein directed to coloring or texturing only a single rope strand applies equally well to coloring or texturing both rope strands.

Moreover, multiple treatments of one or both strands of a length of rope chain are within the scope of the present invention. For example, any of the embodiments described in the previous paragraph, or similar embodiments, resulting in a yellow gold or relatively dark color after treating both rope strands could be subjected to yet another treatment for one or both rope chains in the manner of rhodium striping as shown in FIGS. 25–29.

Thus, while only certain embodiments have been set forth, alternative embodiments and various modifications will be apparent from the above description to those skilled in the art.

While the colors and precious metals used in the descriptions herein are preferred to be yellow, white, rose, and green gold, other colors and other metals, or even non-metals, can be employed in the construction of the disclosed rope chain configurations. Notable alternate materials, for example, are rhodium (in various colors), silver, and nickel, either solid or plated.

The link elements, and/or rope strands after assembly may be enameled using any selectable colored or clear enamel. Similarly, the links and/or rope strands after assembly may be subjected to a surface treatment using blackeners or oxidizers or enamels.

In this connection, new colorization process are continually being developed, and such new colorization processes can be employ in carrying out the inventions equally as well as those specifically described herein. Such new colorization processes may include coloring agents molecularly bonding with the material, or coloring agents penetrating the surface of the material to be embedded several microns below the surface, forming an integral part of the material being colored. The invention is thus not to be considered limited to the specific products and processes shown and described in this specification.

The examples herein of gapped link elements with a rectangular cross section are not to be considered limiting. virtually any cross sectional configuration can be produced for the gapped link elements while maintaining an overall annular configuration, or other configuration not unlike the examples shown in FIGS. 16–33. An attractive rope chain, for example, may be formed using annular gapped link elements having a circular cross section, solid or tubular, resulting in a "soft feel" rope chain with brilliant light reflection patterns.

In this connection, if desired, the interior peripheral edges of the link elements shown in FIGS. 5 and 7–15 may be circular, as shown, or non-circular, leaving the exterior peripheral edges as shown. Alternatively, any combination of circular and non-circular interior peripheral edges and circular and non-circular exterior peripheral edges of the link elements employed in the construction of a rope chain employing the concepts of the present invention are possible, provided the link elements can be assembled in a rope chain fashion.

These and other alternatives are considered equivalents and within the spirit and scope of the present invention.

What is claimed is:

1. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of intertwining helical rope strands; and subsequently colorizing at least a portion of only one of said helical rope strands to exhibit a color for said one helical rope strand different from its color prior to said colorization.

2. The method as claimed in claim 1, wherein:

said provided link elements are all of the same color, and said helical rope strands are of the same color along said length of rope chain prior to said one helical rope strand being colorized.

3. The method as claimed in claim 2, wherein:

said colorizing includes plating said one helical rope strand with rhodium.

4. The method as claimed in claim 3, wherein:

said provided link elements are all made of gold; and said helical rope strands are gold in color prior to plating said one helical rope strand with rhodium.

5. The method as claimed in claim 2, wherein:

said colorizing includes applying a blackener to said one helical rope strand, producing a black finish on said one helical rope strand.

6. The method as claimed in claim 5, wherein:

said provided link elements are all made of gold; and said helical rope strands are gold in color prior to applying a blackener to said one helical rope strand.

7. The method as claimed in claim 2, wherein:

said colorizing includes applying an oxidizer to said one helical rope strand, producing a color finish on said one helical rope strand selected from within the range gray to black.

8. The method as claimed in claim 7, wherein:

said provided link elements are all made of gold; and said helical rope strands are gold in color prior to applying an oxidizer to said one helical rope strand.

9. The method as claimed in claim 2, wherein:

said colorizing includes applying an enamel to said one helical rope strand, producing an enameled finish on said one helical rope strand.

10. The method as claimed in claim 9, wherein:

said provided link elements are all made of gold; and said helical rope strands are gold in color prior to applying an enamel to said one helical rope strand with rhodium.

11. The method as claimed in claim 1, wherein:

said provided link elements are of varying colors, and said helical rope strands are of varying colors along said length of rope chain prior to said one helical rope strand being colorized.

12. The method as claimed in claim 11, wherein:

said colorizing includes plating said one helical rope strand with rhodium.

13. The method as claimed in claim 11, wherein:

said colorizing comprises applying a blackener to said one helical rope strand, producing a black finish on said one helical rope strand.

14. The method as claimed in claim 11, wherein:

said colorizing includes applying an oxidizer to said one helical rope strand, producing a color finish on said one helical rope strand selected from within the range gray to black.

15. The method as claimed in claim 11, wherein:

said colorizing includes applying an enamel to said one helical rope strand, producing an enameled finish on said one helical rope strand.

16. The method as claimed in claim 1, wherein:

said provided link elements exhibit two different colors, such that, when assembled, and prior to said one helical rope strand being colorized, said one helical rope strand is of a first color and said other helical rope strand is of a second color different than said first color.

17. The method as claimed in claim 16, wherein:

said colorizing includes plating said one helical rope strand with rhodium.

18. The method as claimed in claim 16, wherein:

said colorizing includes applying a blackener to said one helical rope strand, producing a black finish on said one helical rope strand.

19. The method as claimed in claim 16, wherein:

said colorizing includes applying an oxidizer to said one helical rope strand, producing a color finish on said one helical rope strand selected from within the range gray to black.

20. The method as claimed in claim 16, wherein:

said colorizing includes applying an enamel to said one helical rope strand, producing an enameled finish on said one helical rope strand.

21. The method as claimed in claim 16, wherein:

said provided link elements are made of two different gold materials exhibiting, respectively, said first and second colors, one of said materials having a small gold karat weight relative to the other of said materials which has a relatively larger gold karat weight, such that, when assembled, and prior to said one helical rope strand being colorized, said one helical rope strand is of said material having the relatively smaller gold karat weight, and said other helical rope strand is of said material having the relatively larger gold karat weight.

22. The method as claimed in claim 21, wherein:

said colorizing includes gold plating said one helical rope strand with gold having a dolor substantially the same as that of said other helical rope strand.

23. The method as claimed in claim 16, wherein:

said provided link elements are made of two different materials exhibiting, respectively, said first and second colors, one of said materials being selected from the group consisting of a non-gold material and a partial gold material, and the other of said materials being of gold having a predetermined gold karat weight, such that, when assembled, and prior to said one helical rope strand being colorized, said one helical rope strand is of said non-gold material, and said other helical rope strand is of said gold material having a predetermined gold karat weight.

24. The method as claimed in claim 23, wherein:

said colorizing includes gold plating said one helical rope strand with gold having a color substantially the same as that of said other helical rope strand.

25. The method as claimed in claim 23, wherein:

said colorizing includes plating said one helical rope strand with rhodium.

26. The method as claimed in claim 23, wherein:

said colorizing includes applying a blackener to said one helical rope strand, producing a black finish on said one helical rope strand.

27. The method as claimed in claim 23, wherein:

said colorizing includes applying an oxidizer to said one helical rope strand, producing a color finish on said one helical rope strand selected from within the range gray to black.

28. The method as claimed in claim 23, wherein:

said colorizing includes applying an enamel to said one helical rope strand, producing an enameled finish on said one helical rope strand.

29. A length of jewelry rope chain, comprising:

a plurality of link elements, each of said link elements being generally C-shaped in configuration to define a gap between facing ends thereof, each of said link elements having a first major surface, an opposite second major surface, an interior edge, and an exterior edge, said plurality of link elements assembled into a series of said gapped link elements to form a length of rope chain having the appearance of intertwining helical rope strands;

a first one of said helical rope strands having a body with a colorized exterior surface portion exhibiting a color different from the color of said first helical rope strand body beneath said colorized exterior surface portion;

a second one of said helical rope strands being devoid of any colorized exterior surface portion.

30. The length of rope chain as claimed in claim 29, wherein:

said colorized exterior surface of said first helical rope strand is a thickness of plated rhodium.

31. The length of rope chain as claimed in claim 29, wherein:

said colorized surface of said first helical rope strand is a surface thickness treated with a blackener, said first helical rope strand exhibiting a black color.

32. The length of rope chain as claimed in claim 31, wherein:

said link elements are all made of gold; and said second helical rope strand is gold in color.

33. The length of rope chain as claimed in claim 29, wherein:

said colorized surface of said first helical rope strand is a surface thickness treated with an oxidizer, said first helical rope strand exhibiting a color selected from within the range of gray to black.

34. The length of rope chain as claimed in claim 33, wherein:

said link elements are all made of gold; and said second helical rope strand is gold in color.

35. The length of rope chain as claimed in claim 29, wherein:

said colorized exterior surface of said first helical rope strand is a thickness of colored enamel.

36. The length of rope chain as claimed in claim 35, wherein:

said link elements are all made of gold; and said second helical rope strand is gold in color.

37. The length of rope chain as claimed in claim 29, wherein:

each said link element has a center point equidistant from opposite points on the interior edge along each said link element;

at least some of said link elements are non-symmetrical about their link element center points; and a length of rope chain made from said non-symmetrical link elements gives the length of rope chain the appearance of a large diameter helical rope strand intertwined with a relatively smaller diameter helical rope strand.

38. The length of rope chain as claimed in claim 37, wherein:

said colorized exterior surface of said first helical rope strand is a thickness of plated rhodium.

39. The length of rope chain as claimed in claim 37, wherein:

said colorized surface of said first helical rope strand is a surface thickness treated with a blackener, said first helical rope strand exhibiting a black color.

40. The length of rope chain as claimed in claim 37, wherein:

said colorized exterior surface of said first helical rope strand is a thickness of plated gold.

41. The length of rope chain as claimed in claim 37, wherein:

said colorized surface of said first helical rope strand is a surface thickness treated with an oxidizer, said first helical rope strand exhibiting a color selected from within the range of gray to black.

42. The length of rope chain as claimed in claim 37, wherein:

said colorized exterior surface of said first helical rope strand is a thickness of colored enamel.

43. A length of jewelry rope chain, comprising:

a plurality of link elements, each of said link elements being generally C-shaped in configuration to define a gap between facing ends thereof, each of said link elements having a first major surface, an opposite second major surface, an interior edge, and an exterior edge, said plurality of link elements assembled into a series of said gapped link elements to form a length of rope chain having the appearance of first and second intertwining helical rope strands; wherein said first helical rope strand has a colorized exterior surface;

said first helical rope strand, beneath said colorized exterior surface, is of a first color different than said colorized exterior surface; and said second helical rope strand is of a second color, different than said first color and different than the colorized exterior surface of said first helical rope strand.

44. The length of rope chain as claimed in claim 43, wherein:

said colorized exterior surface of said first helical rope strand is a thickness of plated rhodium.

45. The length of rope chain as claimed in claim 33, wherein:

said colorized surface of said first helical rope strand is a surface thickness treated with a blackener, said first helical rope strand exhibiting a black color.

46. The length of rope chain as claimed in claim 43, wherein:

said link elements are all made of gold; and said second helical rope strand is gold in color.

47. The length of rope chain as claimed in claim 43, wherein:

said colorized surface of said first helical rope strand is a surface thickness treated with an oxidizer, said first helical rope strand exhibiting a color selected from within the range of gray to black.

48. The length of rope chain as claimed in claim 47, wherein:

said link elements are all made of gold; and said second helical rope strand is gold in color.

49. The length of rope chain as claimed in claim 43, wherein:

said colorized exterior surface of said first helical rope strand is a thickness of colored enamel.

50. The length of rope chain as claimed in claim 49, wherein:

said link elements are all made of gold; and said second helical rope strand is gold in color.

51. The length of rope chain as claimed in claim 43, wherein:

said first helical rope strand, beneath said colorized exterior surface, is made of a material having a small gold karat weight relative to said second helical rope strand made of a material having a relatively larger gold karat weight.

52. The length of rope chain as claimed in claim 51, wherein:

said colorized exterior surface of said first helical rope strand is a thickness of plated gold having a color substantially the same as that of said second helical rope strand.

53. The length of rope chain as claimed in claim 43, wherein:

said second helical rope strand is made of a material having a predetermined gold karat weight, and said first helical rope strand, beneath said colorized exterior surface, is made of a non-gold material.

54. The length of rope chain as claimed in claim 43, wherein:

said colorized exterior surface of said first helical rope strand is a thickness of plated gold having a color substantially the same as that of said second helical rope strand.

55. The length of rope chain as claimed in claim 43, wherein:

said colorized exterior surface of said first helical rope strand is a thickness of plated rhodium.

56. The length of rope chain as claimed in claim 43, wherein:

said colorized surface of said first helical rope strand is a surface thickness treated with a blackener, said first helical rope strand exhibiting a black color.

57. The length of rope chain as claimed in claim 43, wherein:

said colorized surface of said first helical rope strand is a surface thickness treated with an oxidizer, said first helical rope strand exhibiting a color selected from within the range of gray to black.

58. The length of rope chain as claimed in claim 43, wherein:

said colorized exterior surface of said first helical rope strand is a thickness of colored enamel.

59. The method as claimed in claim 1, wherein:

in said providing step, the link elements are non-symmetrical about a link element center point; and a length of rope chain made from said non-symmetrical link elements gives the length of rope chain the appearance of a large diameter helical rope strand intertwined with a relatively smaller diameter helical rope strand.

60. The method as claimed in claim 59, wherein:

said colorizing includes plating said one helical rope strand with rhodium.

61. The method as claimed in claim 59, wherein:

said colorizing includes applying a blackener to said one helical rope strand, producing a black finish on said one helical rope strand.

62. The method as claimed in claim 59, wherein:

said colorizing includes applying an oxidizer to said one helical rope strand, producing a color finish on said one helical rope strand selected from within the range gray to black.

63. The method as claimed in claim 59, wherein:

said colorizing includes applying a colored enamel to said one helical rope strand, producing an enameled finish on said one helical rope strand.

64. The method as claimed in claim 59, wherein:

said colorizing includes plating said one helical rope strand with gold.

65. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of helical rope strands intertwining about an axis of said length of rope chain;

cutting at least one path along the perimeter of said length of rope chain, maintaining said at least one path parallel to said rope chain axis; and subsequently colorizing said at least one path to exhibit a color different from its color prior to said colorization.

66. The method as claimed in claim 65, wherein:

said colorizing includes gold plating said at least one path with gold.

67. The method as claimed in claim 65, wherein:

said colorizing includes plating said at least one path with rhodium.

68. The method as claimed in claim 65, wherein:

said colorizing includes applying a blackener to said at least one path, producing a black finish along said at least one path.

69. The method as claimed in claim 65, wherein:

said colorizing includes applying an oxidizer to said at least one path, producing a color finish along said at least one path selected from within the range gray to black.

70. The method as claimed in claim 65, wherein:

said colorizing includes applying an enamel to said at least one path, producing an enameled finish along said at least one path.

71. The method as claimed in claim 65, wherein:

the number of said paths is an even number, and opposite pairs of said paths extend along said length of rope chain equidistant from said rope chain axis.

72. The method as claimed in claim 71, wherein:

the paths of at least one of said pair of paths are at a distance from said axis different than paths of another of said pair of paths.

73. The method as claimed in claim 65, wherein:

in said providing step, the link elements are non-symmetrical about a link element center point;

a length of rope chain made from said non-symmetrical link elements gives the length of rope chain the appearance of a large diameter helical rope strand intertwined with a relatively smaller diameter helical rope strand; and said cutting and colorizing steps are performed only on said larger diameter helical rope strand.

74. The method as claimed in claim 73, wherein:

said at least one cut path parallel to said axis is linear.

75. The method as claimed in claim 65, wherein:

said at least one cut path parallel to said axis is intermittent along the length of said length of rope chain.

76. A length of jewelry rope chain, comprising:

a plurality of link elements, each of said provided link elements being generally C-shaped in configuration to define a gap between facing ends thereof, a series of said gapped link elements being assembled to construct a length of rope chain having the appearance of helical rope strands intertwining about an axis of said length of rope chain; and at least one path cut into and along the perimeter of said length of rope chain, said at least one path lying parallel to said rope chain axis, said at least one cut path being colorized to exhibit a color different from its color prior to said colorization.

77. The length of rope chain as claimed in claim 76, wherein:

said at least one cut path is colorized by gold plating.

78. The length of rope chain as claimed in claim 76, wherein:

said at least one cut path is colorized by rhodium plating.

79. The length of rope chain as claimed in claim 76, wherein:

said at least one cut path is colorized by the application of a blackener to said at least one path, producing a black finish along said at least one path.

80. The length of rope chain as claimed in claim 76, wherein:

said at least one cut path is colorized by the application of an oxidizer to said at least one path, producing a color finish along said at least one path selected from within the range gray to black.

81. The length of rope chain as claimed in claim 76, wherein:

said at least one cut path is colorized by the application of an enamel to said at least one path, producing an enameled finish along said at least one path.

82. The length of rope chain as claimed in claim 76, wherein:

the number of said paths is an even number, and opposite pairs of said paths extend along said length of rope chain equidistant from said rope chain axis.

83. The length of rope chain as claimed in claim 82, wherein:

the paths of at least one of said pair of paths are at a distance from said axis different than paths of another of said pair of paths.

84. The length of rope chain as claimed in claim 76, wherein:

said link elements are non-symmetrical about a link element center point;

a length of rope chain made from said non-symmetrical link elements gives the length of rope chain the appearance of a large diameter helical rope strand intertwined with a relatively smaller diameter helical rope strand; and said cut and colorized path is located only on said larger diameter helical rope strand.

85. The length of rope chain as claimed in claim 84, wherein:

said at least one cut path parallel to said axis is linear.

86. The length of rope chain as claimed in claim 84, wherein:

said at least one cut path parallel to said axis is intermittent along the length of said length of rope chain.

87. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of helical rope strands intertwining about an axis of said length of rope chain;

subsequently colorizing at least one path along the perimeter of said length of rope chain to exhibit a color different from its color prior to said colorization, maintaining said at least one path in registration with at least one of said rope strands, whereby said at least one path is helical about said rope chain axis.

88. The method as claimed in claim 87, wherein:

said colorizing is selected from the group consisting of rhodium plating, gold plating, applying a blackener, applying an oxidizer, and enameling.

89. The method as claimed in claim 87, wherein:

said at least one path is intermittent along the length of said length of rope chain.

90. The method as claimed in claim 87, comprising, prior to said colorizing:

cutting portions of said length of rope chain along the perimeter thereof, said at least one colorized path extending along said cut portions.

91. A length of jewelry rope chain, comprising:

a plurality of link elements, each of said provided link elements being generally C-shaped in configuration to define a gap between facing ends thereof, a series of said gapped link elements being assembled to construct a length of rope chain having the appearance of two helical rope strands intertwining about an axis of said length of rope chain; and a single colorized path along the perimeter of said length of rope chain exhibiting a color different from the color outside said single path, said single path being in registration with one of said rope strands, whereby said single path is helical about said rope chain axis, the other of said helical rope strands being devoid of a differently colorized path.

92. The length of jewelry rope chain as claimed in claim 91, wherein:

said single path along the perimeter of said length of rope chain comprises a surface thickness selected from the group consisting of plated rhodium, plated gold, a layer of blackened gold, a layer of oxidized gold, and enamel.

93. A length of jewelry rope chain, comprising:

a plurality of link elements, each of said provided link elements being generally C-shaped in configuration to define a gap between facing ends thereof, a series of said gapped link elements being assembled to construct a length of rope chain having the appearance of two helical rope strands intertwining about an axis of said length of rope chain;

a single colorized path along the perimeter of said length of rope chain exhibiting a color different from the color outside said single path, said single path being in registration with one of said rope strands, whereby said single path is helical about said rope chain axis, the other of said helical rope strands being devoid of a differently colorized path; and wherein said single path is intermittent along the length of said length of rope chain.

94. The length of jewelry rope chain as claimed in claim 91, wherein said one rope strand has an outer periphery; and said path is located along the outer periphery of said one rope strand.

95. The length of jewelry rope chain as claimed in claim 91, wherein:

said apparent intertwining rope strands define helical V-shaped channels between said rope strands; and said helical path is located along at least one channel of the length of rope chain.

96. The length of jewelry rope chain as claimed in claim 91, comprising:

cut portions of said length of rope chain along the perimeter thereof, said single colorized path extending along said cut portions.

97. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of two helical rope strands intertwining about an axis of said length of rope chain; and subsequently texturing at least a portion of one of said helical rope strands to exhibit texture for said one helical rope strand portion different from its texture prior to said texturing and different from the texture of the other helical rope strand.

98. The method as claimed in claim 97, wherein:

said provided link elements all have the same texturing, and said helical rope strands have the same texturing along said length of rope chain prior to said one helical rope strand portion being textured.

99. The method as claimed in claim 97, wherein:

said provided link elements are of varying textures, and said helical rope strands are of varying textures along said length of rope chain prior to said one helical rope strand portion being textured.

100. The method as claimed in claim 98, wherein:

said texturing includes texturing a portion of said one helical rope strand on the outer periphery thereof.

101. The method as claimed in claim 99, wherein:

said texturing includes texturing a portion of said one helical rope strand on the outer periphery thereof.

102. The method as claimed in claim 98, wherein:

said apparent intertwining rope strands define helical V-shaped channels between said rope strands; and said texturing includes texturing a portion of said one helical rope strand along at least one channel thereof.

103. The method as claimed in claim 99, wherein:

said apparent intertwining rope strands define helical V-shaped channels between said rope strands; and said texturing includes texturing a portion of said one helical rope strand along at least one channel thereof.

104. The method as claimed in claim 97, wherein:

said provided link elements exhibit two different textures, such that, when assembled, and prior to said one helical rope strand being textured, said one helical rope strand is of a first texture and said other helical rope strand is of a second texture different than said first texture.

105. The method as claimed in claim 97, wherein said texturing comprises:

texturing at least a portion of the other of said helical rope strands to exhibit texture for said other helical rope strand portion different from its texture prior to said texturing.

106. The method as claimed in claim 105, wherein:

said texturing includes texturing a portion of said one helical rope strand on the outer periphery thereof.

107. The method as claimed in claim 105, wherein:

said apparent intertwining rope strands define helical V-shaped channels between said rope strands; and said texturing includes texturing a portion of said one helical rope strand along at least one channel thereof.

108. The method as claimed in claim 97, wherein:

at least a portion of one of said rope strands is textured in the form of at least one of the group consisting of a serrated surface, a sandblasted surface, a series of angled plate-like surfaces having a saw-toothed profile, V-shaped grooved surface, and a diamond cut surface.

109. The method as claimed in claim 97, comprising:

cutting at least one path along the perimeter of said length of rope chain, maintaining said at least one path parallel to said rope chain axis.

110. The method as claimed in claim 109, comprising:

subsequently texturing said at least one path to exhibit a texture different from its texture prior to said texturing.

111. The method as claimed in claim 109, wherein:

the number of said paths is an even number, and a pair of said paths extends along said length of rope chain equidistant from said rope chain axis.

112. The method as claimed in claim 111, wherein:

the paths of at least one of said pair of paths are at a distance from said axis different than paths of another of said pair of paths.

113. The method as claimed in claim 110, wherein:

in said providing step, the link elements are non-symmetrical about a link element center point;

a length of rope chain made from said non-symmetrical link elements gives the length of rope chain the appearance of a large diameter helical rope strand intertwined with a relatively smaller diameter helical rope strand; and said cutting and texturing steps are performed only on said larger diameter helical rope strand.

114. The method as claimed in claim 109, wherein:

said at least one cut path parallel to said axis is intermittent along the length of said length of rope chain.

115. The method as claimed in claim 97, wherein said texturing includes:

texturing at least one path along the perimeter of said length of rope chain to exhibit a texture different from its texture prior to said texturing, maintaining said at least one path in registration with at least one of said rope strands, whereby said at least one path is helical about said rope chain axis.

116. The method as claimed in claim 115, wherein:

at least a portion of one of said rope strands is textured in the form of at least one of the group consisting of a serrated surface, a sandblasted surface, a series of angled plate-like surfaces having a saw-toothed profile, a V-shaped grooved surface, and a diamond cut surface.

117. The method as claimed in claim 115, comprising, prior to said texturing:

cutting portions of said length of rope chain along the perimeter thereof, said at least one textured path extending along said cut portions.

118. A length of textured jewelry rope chain, comprising:

a plurality of link elements, each of said link elements being generally C-shaped in configuration to define a gap between facing ends thereof, each of said link elements having a first major surface, an opposite second major surface, an interior edge, and an exterior edge, said plurality of link elements assembled into a series of said gapped link elements to form a length of rope chain having the appearance of helical rope strands intertwining about an axis of said rope chain;

one of said helical rope strands having a textured exterior surface portion exhibiting a texture different from the texture of said length of rope chain external to said textured exterior surface portion.

119. The length of rope chain as claimed in claim 118, wherein:

a portion of said one helical rope strand is textured on the outer periphery thereof.

120. The length of rope chain as claimed in claim 118, wherein:

said apparent intertwining rope strands define helical V-shaped channels between said rope strands; and a portion of said one helical rope strand is textured along at least one channel thereof.

121. The length of jewelry rope chain as claimed in claim 118, comprising:

at least one path cut into and along the perimeter of said length of rope chain, said at least one path lying parallel to said rope chain axis.

122. The length of jewelry rope chain as claimed in claim 121, wherein:

said at least one cut path is textured to exhibit a texture different from that on either side of said cut path.

123. The length of rope chain as claimed in claim 121, wherein:

the number of said paths is an even number, and opposite pairs of said paths extend along said length of rope chain equidistant from said rope chain axis.

124. The length of rope chain as claimed in claim 123, wherein:

the paths of at least one of said pair of paths are at a distance from said axis different than paths of another of said pair of paths.

125. The length of rope chain as claimed in claim 122, wherein:

said link elements are non-symmetrical about a link element center point;

a length of rope chain made from said non-symmetrical link elements gives the length of rope chain the appearance of a large diameter helical rope strand intertwined with a relatively smaller diameter helical rope strand; and said cut and textured path is located only on said larger diameter helical rope strand.

126. The length of jewelry rope chain as claimed in claim 118, comprising:

at least one textured path along the perimeter of said length of rope chain exhibiting a texture different from the texture outside said path, said at least one path being in registration with at least one of said rope strands, whereby said at least one path is helical about said rope chain axis.

127. The length of jewelry rope chain as claimed in claim 126, wherein:

said at least one path is textured by a method of texturing at least a portion of one of said rope strands in the form of at least one of the group consisting of a serrated surface, a sandblasted surface, a series of angled plate-like surfaces having a saw-toothed profile, a V-shaped grooved surface, and a diamond cut surface.

128. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of intertwining helical rope strands;

subsequently altering the visual property of at least a portion of only one of said helical rope strands to exhibit a visual property for said one helical rope strand different from its visual property prior to being altered; and wherein said altering of the visual property of at least a portion of only one of said helical rope strands comprises texturing said portion by mechanically or chemically treating said one helical rope strand to produce a sandblast, matt, or frost-like finish.

129. A method for manufacturing a length of jewelry rope chain, comprising:

providing a plurality of link elements, each of said provided link elements being generally C-shaped in configuration to define a gap between facing ends thereof;

assembling a series of said gapped link elements to construct a length of rope chain having the appearance of intertwining helical rope strands;

subsequently altering the visual property of at least a portion of only one of said helical rope strands to exhibit a visual property for said one helical rope strand different from its visual property prior to being altered; and wherein said altering of the visual property of at least a portion of only one of said helical rope strands comprises at least one process selected from the group consisting of: selective acid etching; electro-etching away surface material in the manner of EDM electro-machining; surface ablating; surface furbishing; and surface grinding with a small rotary tool or diamond cutting tool.

* * * * *